US007302205B2

(12) United States Patent
Shintani et al.

(10) Patent No.: US 7,302,205 B2
(45) Date of Patent: Nov. 27, 2007

(54) PROCESS CARTRIDGE AND IMAGE FORMING APPARATUS

(75) Inventors: Takeshi Shintani, Kawasaki (JP); Akira Fujimori, Yokohama (JP); Kaoru Yoshino, Meguro-ku (JP); Satoshi Hatori, Yokohama (JP); Hiroshi Ono, Yokohama (JP); Nobuo Kikuchi, Kawagoe (JP); Kunihiro Ohyama, Fuchu (JP)

(73) Assignee: Ricoh Company, Ltd., Tokyo (JP)

( * ) Notice: Subject to any disclaimer, the term of this patent is extended or adjusted under 35 U.S.C. 154(b) by 188 days.

(21) Appl. No.: 11/043,654

(22) Filed: Jan. 27, 2005

(65) Prior Publication Data

US 2005/0169663 A1 Aug. 4, 2005

(30) Foreign Application Priority Data

| | | |
|---|---|---|
| Jan. 29, 2004 | (JP) | 2004-021765 |
| Jan. 30, 2004 | (JP) | 2004-023240 |
| Mar. 2, 2004 | (JP) | 2004-057323 |
| Nov. 1, 2004 | (JP) | 2004-318372 |

(51) Int. Cl.
*G03G 21/16* (2006.01)

(52) U.S. Cl. ..... 399/111; 113/125

(58) Field of Classification Search ..... 399/107, 399/108, 109, 110, 111, 113, 125
See application file for complete search history.

(56) References Cited

U.S. PATENT DOCUMENTS

| | | | | |
|---|---|---|---|---|
| 5,170,209 | A * | 12/1992 | Tompkins et al. | 399/107 |
| 5,583,618 | A * | 12/1996 | Takeuchi et al. | 399/111 |
| 6,868,243 | B2 * | 3/2005 | Watanabe et al. | 399/113 |
| 6,871,031 | B2 * | 3/2005 | Blaine et al. | 399/113 |
| 6,879,792 | B2 * | 4/2005 | Carter et al. | 399/113 |
| 2004/0105300 | A1 | 6/2004 | Chuang et al. | |
| 2004/0265011 | A1 | 12/2004 | Tsuda et al. | |
| 2005/0169663 | A1 | 8/2005 | Shintani et al. | |

FOREIGN PATENT DOCUMENTS

| | | | |
|---|---|---|---|
| JP | 01-142666 | | 6/1989 |
| JP | 04-274452 | | 9/1992 |
| JP | 07-302033 | | 11/1995 |
| JP | 07-334036 | | 12/1995 |
| JP | 08-101624 | | 4/1996 |
| JP | 08-314352 | | 11/1996 |
| JP | 9-222840 | * | 8/1997 |
| JP | 09-251264 | | 9/1997 |

(Continued)

OTHER PUBLICATIONS

U.S. Appl. No. 11/557,070, filed Nov. 6, 2006, Ohyama.

*Primary Examiner*—Hoan Tran
(74) *Attorney, Agent, or Firm*—Oblon, Spivak, McClelland, Maier & Neustadt, P.C.

(57) ABSTRACT

A process cartridge configured to be detachably mounted in an image forming apparatus. A second body member is mounted on a first body member so that at least one of the first and second body members moves between an opened position and a closed position. An auxiliary device is configured to be mounted on at least one of the first and second body members via an opened space formed after at least one of the first and second body members is moved to the opened position.

63 Claims, 26 Drawing Sheets

FOREIGN PATENT DOCUMENTS

| | | |
|---|---|---|
| JP | 2001-331082 | 11/2001 |
| JP | 2003-076249 | 3/2003 |
| JP | 2003-177651 | 6/2003 |
| JP | 2003-186305 | 7/2003 |
| JP | 2003-241619 | 8/2003 |

* cited by examiner

PROCESS CARTRIDGE AND IMAGE FORMING APPARATUS

BACKGROUND OF THE INVENTION

1. Field of the Invention

The present invention relates to a process cartridge and an image forming apparatus, and more specifically to the process cartridge for forming images in a copying apparatus, a facsimile apparatus, a printer or the like by an electrostatic image transfer process, and to the image forming apparatus which uses the process cartridge.

2. Discussion of the Related Art

In an image forming apparatus, a developing unit consumes toner during image formation. In the case of a two-component developing agent, a magnetic carrier needs to be replaced. Other members within the image forming apparatus, such as a photoconductive body which wears out and deteriorates after a long period of use, a charging unit which becomes dirty due to airborne and scattering toner within the image forming apparatus, and a cleaning blade wears out due to contact with the photoconductive body, also need to be replaced. Restated, the members and units described above must be replaced in order to prevent the images of the character dust, the surface fogging and the like from being generated.

Accordingly, when the character dust or the like is generated, a service or maintenance person goes to the setup site of the image forming apparatus of the user, and replaces the members and/or units. However, the durability of each member and unit within the image forming apparatus has improved, and the serviceable life of the developing agent or the like used in the image forming apparatus has also been extended. Consequently, the need for the service person to attend to the maintenance of the image forming apparatus has decreased. Conversely, when the maintenance person actually attends to the maintenance of the image forming apparatus, it may take an extremely long work time to remove each member or unit within the image forming apparatus and to mount a new member or unit in the image forming apparatus.

Thus, a process cartridge which is detachable with respect to a main body of the image forming apparatus has been proposed. The process cartridge integrally supports a process device such as a charging device, a developing device and a cleaning device. The work time of the service person who attends to the maintenance of the image forming apparatus of the user can be reduced by replacing the process cartridge. In some cases, the user himself can easily replace the process cartridge without requiring the service person to attend to the maintenance by going to the setup site of the image forming apparatus. The serviceable life may be different for each member or unit. For example, the serviceable life of the photoconductive body is from 10,000 prints to 80,000 prints, the serviceable life of the magnetic carrier in the developing unit is from 50,000 prints to 100,000 prints, and the serviceable life of the charting unit is from 30,000 prints to 80,000 prints. Conventionally, the user or service person replaces the entire process cartridge regardless of the different serviceable lives of the members and units within the process cartridge. As a result, it is convenient in that the entire process cartridge simply needs to be replaced, but from the point of view of efficiently utilizing the resources, it is inconvenient in that a serviceable member or unit within the process cartridge will be replaced when the serviceable life of one member or unit within the process cartridge ends.

From the point of view of the user, there were demands to enable each member or unit usable until the serviceable life thereof ends.

Japanese Laid-Open Patent Publication no. 2003-177651 shows a process cartridge having a cleaning member which removes residual toner on the photoconductive body, and a removed toner accommodating part which accommodates the removed toner. The removed toner accommodating part includes a container-shaped cleaning frame body including a first opening confronting the photoconductive body and a second opening located at a position separated from the first opening, a cleaning member substantially covering the first opening, and a lid frame body provided in a periphery of the second opening. A resilient seal member is provided between the lid frame member and a support part of the cleaning member. According to this proposed process cartridge, the size of both the removed toner container and the process cartridge can be reduced, while accommodating a large amount of toner and improving the amount of removed toner that can be accommodated.

Japanese Laid-Open Patent Publication no. 2003-186305 shows a process cartridge having assembled therein a latent image bearing member and at least one process unit. A developing agent supply box and a removed developing agent recovery box communicate with a developing housing which accommodates a developing agent. The developing agent supply box is disposed at a position on an upstream side of a latent image write position on the latent image bearing member, and the removed developing agent recovery box is disposed at a position on a downstream side of the latent image write position.

Japanese Laid-Open Patent Publication no. 2001-331082 shows a process cartridge which integrally includes at least a developing unit, and one of a charging unit, an electrophotography photoconductive body and a cleaning unit of the electrophotography photoconductive body. The process cartridge is detachably loaded with respect to a main body of an image forming apparatus, and has a structure which enables the process cartridge to be hand-held and easily shaken.

Japanese Laid-open Patent Publication no. 09-251264 shows a process cartridge, which integrally includes a cleaning unit having an electrical conductive roller having a fur blush, which removes the residual toner on image carrier, and an electrical conductive roller electrically collecting the residual toner removed by the electrical conductive roller.

Japanese Laid-open Patent Publication no. 08-314352 shows a developing unit, which includes a case for a photoconductive element detachably mounted, and a cleaning device detachably mounted on the case.

Japanese Laid-open Patent Publication no. 2003-241619 shows a process cartridge, which includes a developing device positioned and connected by a resin-bonding agent with a side cover of the process cartridge.

Japanese Laid-open Patent Publication no. 07-334036 shows a process cartridge, which includes a driving mechanism from a main body of an image forming apparatus to a latent image bearing member of a process cartridge.

Japanese Laid-Open Patent Publications nos. 2003-177651, 2003-186305, and 2001-331082, can result in a problem in that a process cartridge is collectively replaced by a new one. Further, Japanese Laid-Open Patent Publication no. 09-251264 may result in a problem in that a cleaning device could not be replaced. Further, Japanese Laid-Open Patent Publication no. 08-314352 may result in a problem in that it is necessary to remove a cleaning device from a process cartridge. Further, Japanese Laid-open Patent Publication no. 2003-241619 may result in a problem in that a developing device can not be replaced from a process cartridge. Further, Japanese Laid-open Patent Publication no. 07-334036 may result in a problem in that removal of the driving mechanism from a main body of an image forming apparatus to a latent image bearing member of a process cartridge is complicated.

SUMMARY OF THE INVENTION

To address the above-described and other problems, it is an object of the present invention to provide a process cartridge configured to be detachably mounted in an image forming apparatus. A second body member is mounted on a first body member so that at least one of the first and second body members moves between an opened position and a closed position. An auxiliary device is configured to be mounted on at least one of the first and second body members via an opened space formed after at least one of the first and second body members is moved to the opened position.

The present invention further provides a process cartridge configured to be detachably mounted in an image forming apparatus including a developing module. The developing module includes a developer bearing member configured to supply a developing agent to an image bearing member. A magnet unit having a predetermined main pole direction is mounted inside the developer bearing member. A rotatable shaft is configured to rotate the magnet unit. A positioning member is configured to position the developing module on the process cartridge. An angular positioning member is configured to engage the rotatable shaft to determine the predetermined main pole direction of the magnet unit.

The present invention further provides a process cartridge configured to be detachably mounted in an image forming apparatus. Means for cooperating with means for bearing an image is configured to be mounted to means for opening and closing a space. The means for cooperating is configured to be mounted via an opened space formed after the means for opening and closing is opened.

The present invention further provides an image forming apparatus including a process cartridge. The process cartridge includes a image bearing member, an auxiliary device, a first body member, and a second body member moveably mounted on the first body member so that at least one of the first and second body members moves between an opened position and a closed position. The auxiliary device is configured to be mounted to the process cartridge via an opened space formed after at least one of the first and second body members is moved to the opened position, after the process cartridge is removed from the image forming apparatus.

The present invention still further provides an image forming apparatus including a process cartridge with an image bearing member, and a developing module configured to be detachably mounted on the process cartridge. The developing module includes a developer bearing member configured to supply a developing agent to an image bearing member, a magnet unit having a predetermined main pole direction, disposed inside the developer bearing member, and a rotatable shaft configured to rotate the magnet unit. A positioning member is configured to position the developing module on the process cartridge. An angular positioning member is configured to engage the rotatable shaft to determine the predetermined main pole direction of the magnet unit.

The present invention still further provides a process cartridge configured to be detachably mounted in an image forming apparatus, including means for cooperating with means for bearing an image, means for mounting the means for bearing and the means for cooperating in first and second body members, and means for connecting the first and second body members to move between an opened position and a closed position. The means for cooperating is configured to be mounted via an opened space formed after at least one of the first and second body members is moved to the opened position.

The present invention still further provides a process cartridge configured to be detachably mounted in an image forming apparatus, including means for bearing an image, means for supplying a developing agent to the means for bearing, the means for supplying including a developing sleeve, means for attracting the developing agent, the means for attracting including a magnet unit, means for determining a position between the developing sleeve and the means for bearing, and means for determining an angular position of a predetermined main pole direction of the magnet unit.

The present invention still further provides an image forming apparatus, including means for cooperating with means for bearing an image, means for mounting the means for bearing and the means for cooperating in first and second body members, and means for connecting the first and second body members to move between an opened position and a closed position. The means for cooperating is configured to be mounted via an opened space formed after at least one of the first and second body members is moved to the opened position.

The present invention still further provides an image forming apparatus, including means for bearing an image, means for supplying a developing agent to the means for bearing, the means for supplying including a developing sleeve inside a developing module, means for attracting the developing agent by a magnet unit inside the developing sleeve, means for determining a preliminary position between the developing module and the means for bearing, and means for determining an angular position of a predetermined main pole direction of the magnet unit.

The present invention still further provides a method for positioning for an image forming apparatus. The method includes determining a preliminary position between a developing module and an image bearing member of a process cartridge, determining an angular position of a predetermined main pole direction of a magnet unit inside the developing module, and positioning the process cartridge in the image forming apparatus.

It is to be understood that both the foregoing general description of the invention and the following detailed description are exemplary, but are not restrictive of the invention.

BRIEF DESCRIPTION OF THE DRAWINGS

The accompanying drawings, which are incorporated in and constitute a part of the specification, illustrate the invention, and, together with the description, serve to explain the principles of the invention.

DESCRIPTION OF THE INVENTION

Figure 1:
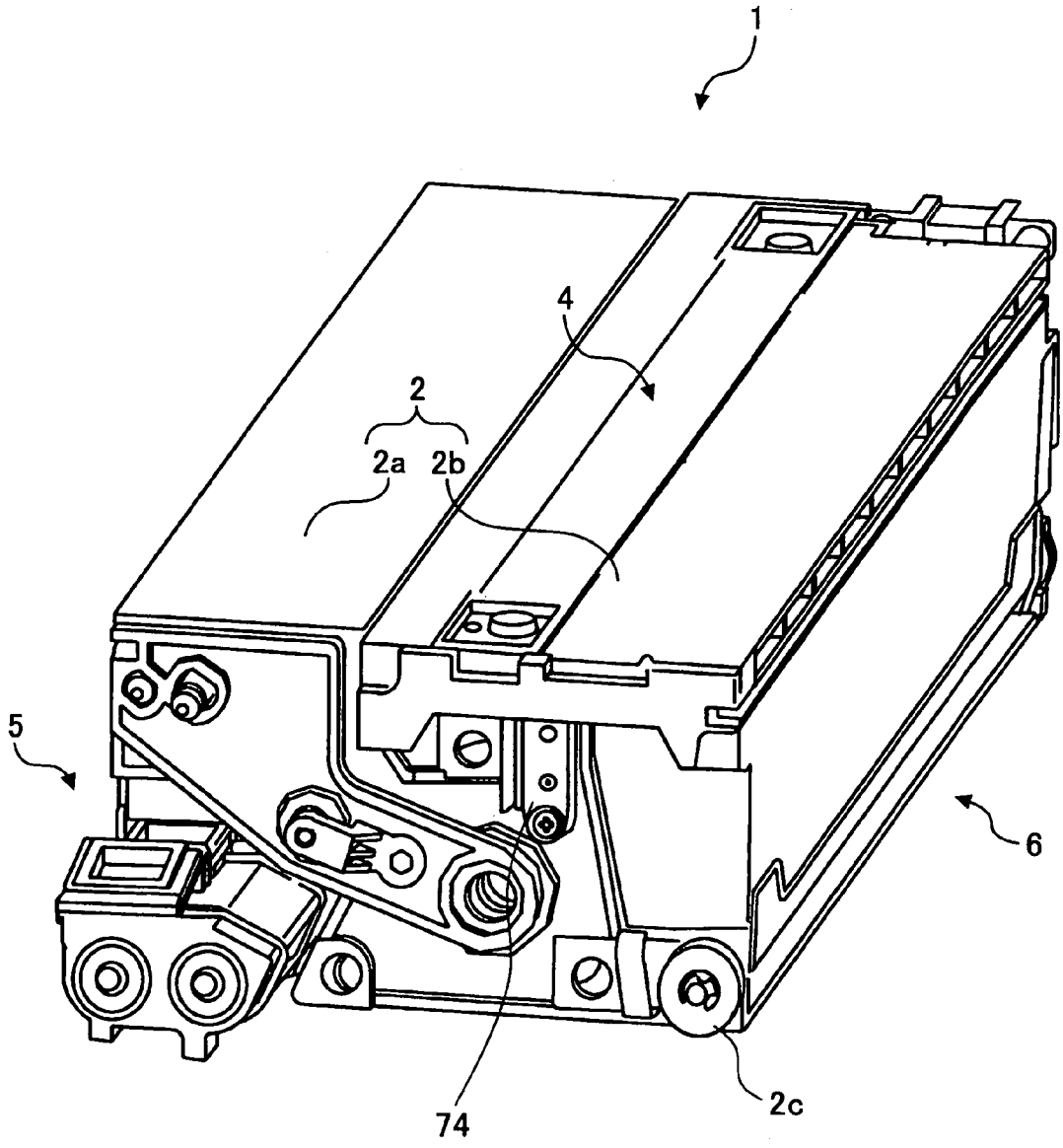
FIG. 1 is a perspective view of a process cartridge according to the present invention.
Figure 2:
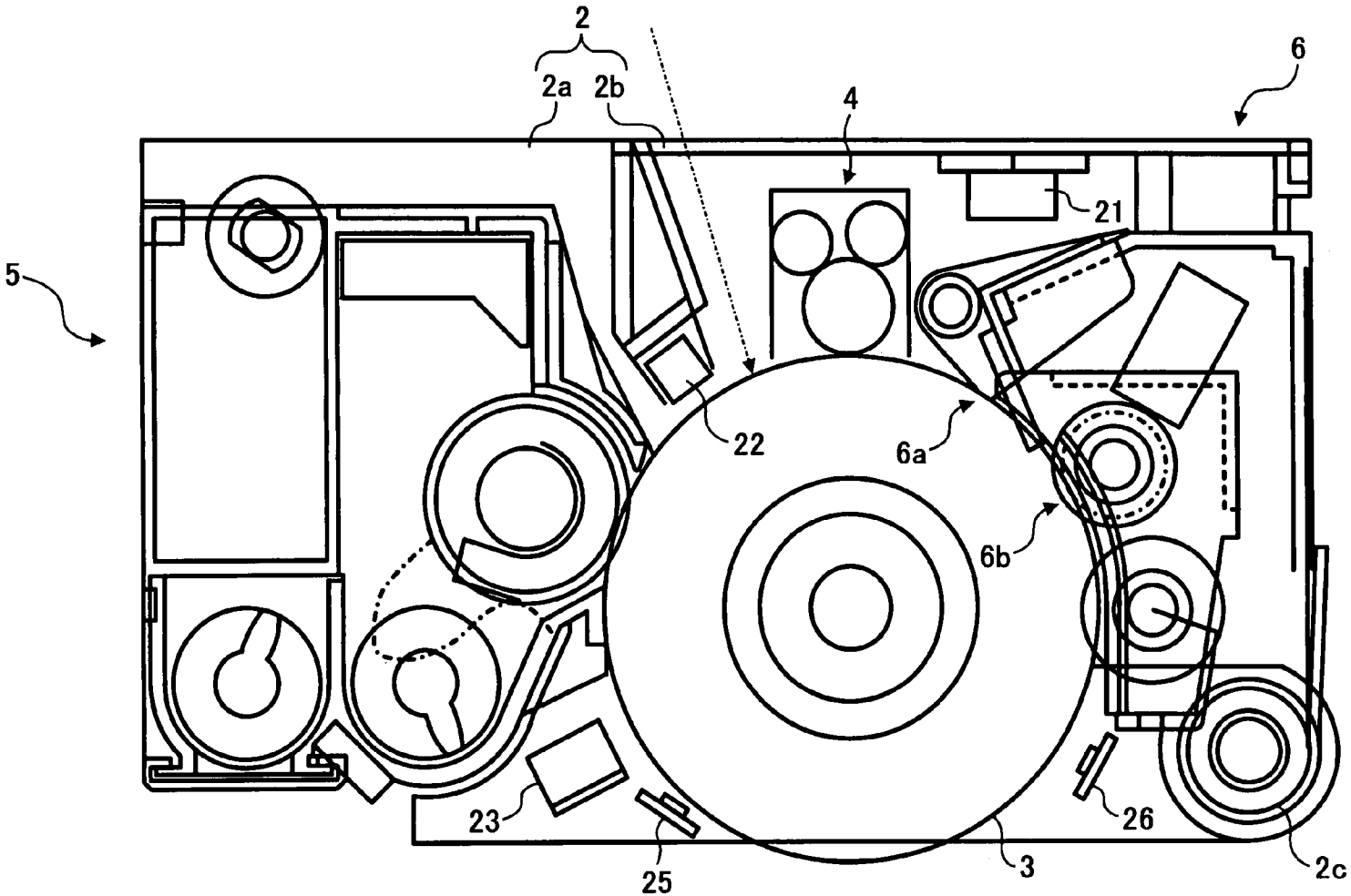
FIG. 2 is a cross sectional view of the process cartridge of FIG. 1.

FIG. 1 is a perspective view of a process cartridge according to the present invention, and FIG. 2 is a cross sectional view of the process cartridge of FIG. 1.

As shown in FIGS. 1 and 2, a process cartridge 1 includes a process cartridge frame body 2. The process cartridge frame body 2 may have a latent image bearing member, a charging device or unit, a developing device or unit, and/or a cleaning device or unit, which are provided as a process device. For example, the latent image bearing member may be formed by a photoconductive body 3, the charging device or unit may be formed by a charging module 4, the developing device or unit may be formed by a developing module 5, and the cleaning device or unit may be formed by a cleaning module 6. The process cartridge 1 itself is replaceable. In addition, when the process cartridge 1 is removed from a main body of an image forming apparatus 100, each of the photoconductive body 3, the charging module 4, the developing module 5 and the cleaning module 6 may be replaced by a new body or module. In addition, each module may be handled independently by a service person or a user.

Figure 3A:
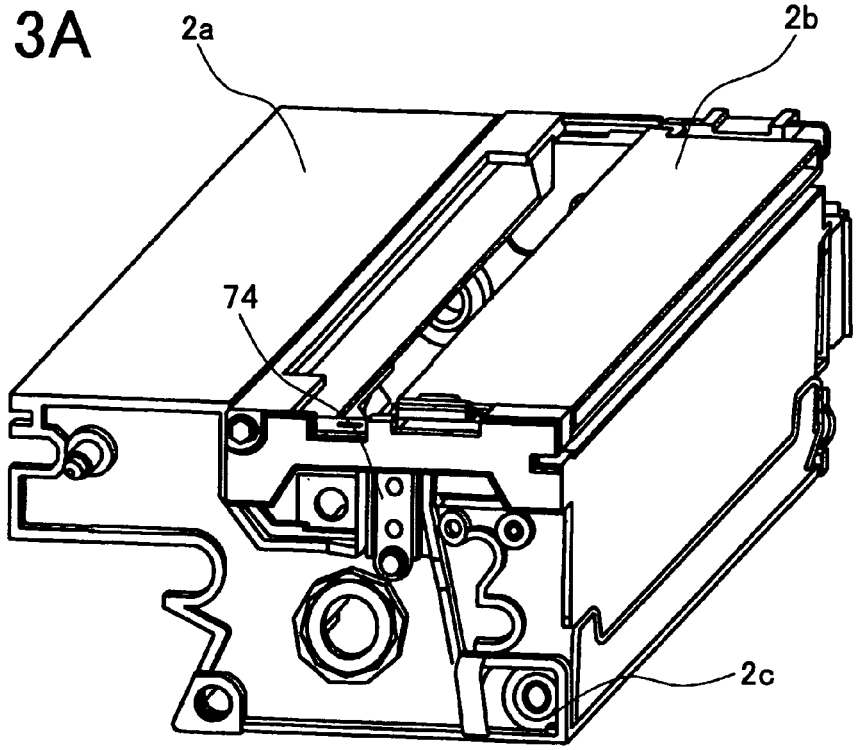
FIGS. 3A and 3B are front and rear perspective views of an image forming apparatus including a process cartridge frame body.
Figure 3B:
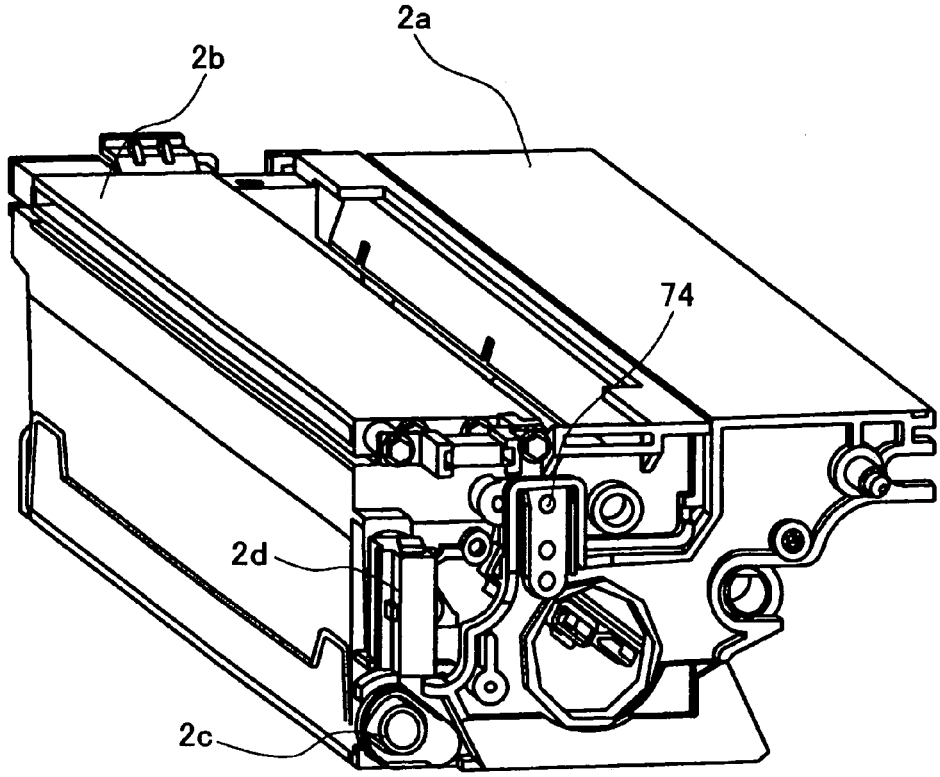

FIGS. 3A and 3B are front and rear perspective views of the image forming apparatus 100 including the process cartridge frame body 2.

The process cartridge frame body 2 includes a first frame body 2*a* and a second frame body 2*b* connected in a pivotable manner about an engaging part 2*c* which forms a rotary axis, between an open position and a closed position. In the closed position, the first and second frame bodies 2*a* and 2*b* surround the photoconductive body 3 so that the photoconductive body 3 cannot be removed. Projecting portions and hole portions (not shown) are provided in the first and second frame bodies 2*a* and 2*b*, the projecting portions inserted through the corresponding hole portions. The engaging part 2*c* holds the projecting portion by a ring to prevent the projecting portion from slipping out of the hole portion.

One or more pins (e.g., two pins) penetrate a frame body positioning member 74 with respect to an opening that is provided at location where the first and second frame bodies 2*a* and 2*b* overlap in the closed position, to simultaneously position and fix the first and second frame bodies 2*a* and 2*b*. Accordingly, the process cartridge frame body 2 can be assembled from the first and second frame bodies 2*a* and 2*b* which are separate from one another, without having to integrally form the process cartridge frame body 2, and the first and second frame bodies 2*a* and 2*b* can easily be separated. For this reason, the photoconductive body 3 and each process device or unit 4 can be replaced independently. In this particular case, the first and second frame bodies 2*a* and 2*b* are pivotable about the engaging part 2*c* which forms the rotary axis, but the first and second frame bodies 2*a* and 2*b* are not limited to this structure. For example, the first and second frame bodies 2*a* and 2*b* may have a structure such that the first and second frame bodies 2*a* and 2*b* are slidable between the open position and the closed position.

Figure 29:
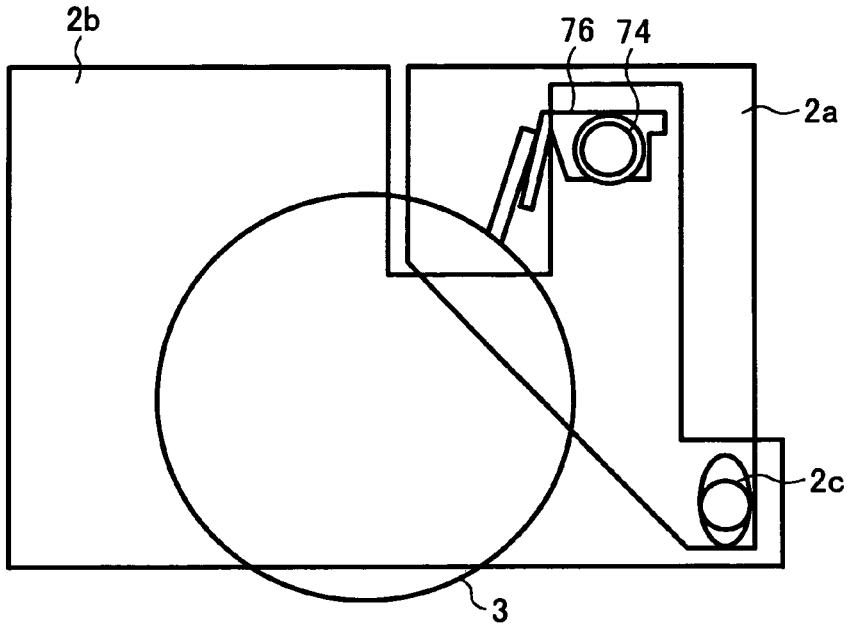
FIG. 29 is a sectional drawing showing a frame body positioning member.
Figure 30:
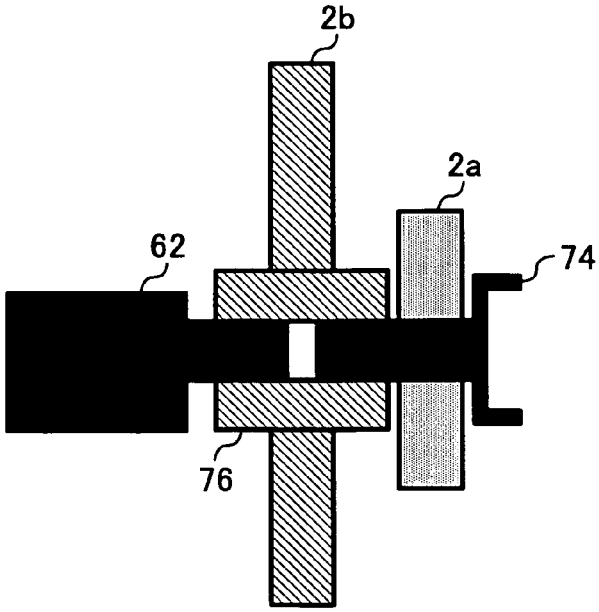
FIG. 30 is a cross sectional view of first and second frame bodies, and a frame body positioning member.

Further, as shown in FIG. 29 and FIG. 30, a location where the first and second frame bodies 2*a* and 2*b* are fixed and positioned by the frame body positioning member 74, is penetrated by a blade positioning member 76 holding a cleaning blade 61. Therefore, it is possible to position the cleaning blade 61 to accurately contact the photoconductive body 3. By this arrangement, the cleaning ability of the cleaning blade is increased.

The process cartridge frame body 2 may be provided with one or more detecting devices or units, as shown in FIG. 2. The detecting device or unit may include a temperature and humidity sensor 21 for detecting a temperature and a humidity within the process cartridge 1, a potential sensor 22 for detecting an electric potential of the photoconductive body 3, and/or a toner density sensor 23 for detecting an amount of toner developed on the photoconductive body 3 after developing.

The temperature and humidity sensor 21 is disposed on the second frame body 2*b*. The temperature and humidity sensor 21 may detect the temperature and humidity by a detecting element, such as a microtemperature sensing element having a positive or negative temperature characteristic. For example, the microtemperature sensing element may be a microstrip, a thin film or thermistor formed from platinum, tungsten, nichrome or kanthal having a positive temperature characteristic or formed from carbon silicide (SiC) or tantalum nitride (TaN) having a negative temperature characteristic. Although FIG. 2 shows that the temperature and humidity sensor 21 is disposed on a top portion of the second frame body 2*b*, the temperature and humidity sensor 21 can be located at any position on the second frame body 2*b*.

The potential sensor 22 is disposed on the second frame body 2*b*, and includes a potential detecting part which may be controlled by a controller within the main body of the image forming apparatus 100. The potential sensor 22 can detect a surface potential of the photoconductive body 3 by being disposed from about 1 mm to about 3 mm from a surface of the photoconductive body 3.

As shown in FIG. 2, the potential sensor 22 is disposed between the charging module 4 and the developing module 5 in a top portion of the first frame body 2*a*, on a downstream side of an exposing laser beam. In this position, the potential detecting part of the potential sensor 22 detects the potential of the photoconductive body 3 which is formed with a latent image that becomes a patch-shaped solid black part, and a detection signal of the detected potential is sent to the controller of the image forming apparatus 100 via a signal line (or wire harness) 24. The controller of the image forming apparatus 100 determines a magnitude of a developing bias voltage which is to be applied to the developing module 5 based on the detection signal, and applies a suitable developing bias voltage to the developing module 5. The position of the potential sensor 22 is not limited to that described above. For example, the potential sensor 22 may detect the potential of the photoconductive body 3 which is formed with a latent image that becomes a white background part, and a light quantity (or intensity) and/or exposure time of the laser beam which forms the solid black part may be controlled based on the detected signal.

The toner density sensor 23 is disposed on the first frame body 2*a*. The latent image of the solid black part formed outside an image forming region on the photoconductive body 3 is visualized by the toner, and the amount of adhered toner at the solid black part is optically detected by the toner density sensor 23 as an image tone. A detection signal of the detected amount of adhered toner is sent to the controller of the image forming apparatus 100. The toner density sensor 23 includes a light emitting element (such as an LED) and a light receiving element (not shown), and detects the amount of adhered toner on the photoconductive body 3 by irradiating light from the light emitting element on the solid black part and detecting the amount of reflected light from the solid black part by the light receiving element. The toner density of the developing agent (or developer) accommodated within the developing module 5 is determined from a table stored in the controller of the image forming apparatus 100 based on the detection signal from the toner density sensor 23. The toner density sensor 23 is disposed on a downstream side of the developing module 5. By disposing the various sensors related to the photoconductive body 3 on the first frame body 2*a* or the second frame body 2*b*, it becomes possible to easily replace each process device or unit of the process cartridge 1. In addition, it is possible to provide process devices or units that are replaceable and inexpensive.

The signal lines (or wiring harnesses) are gathered at a rear side of the process cartridge 1, and collectively connected to a connector part 2*d* which is provided on the rear side of the process cartridge 1. The connector part 2*d* connects to a connector part of the main body of the image forming apparatus 100, to be electrically connected to an electrical circuit within the main body of the image forming apparatus 100. The signal lines (wiring harnesses) reach the connector part 2*d* by being routed along the engaging part 2*c* which forms the rotary axis. Accordingly, the first and second frame bodies 2*a* and 2*b* of the process cartridge frame body 2 can pivot (or turn) freely, to thereby improve the replaceability of each process device or unit.

A pretransfer discharge unit 25 and/or a precleaning discharge unit 26 can be provided. By disposing the pretransfer discharge unit 25 on an upstream side of a transfer region and disposing the precleaning discharge unit 26 on a downstream side of the transfer region and on an upstream side of the cleaning module 6, and attenuating the charge on the photoconductive body 3, the transfer and/or cleaning is facilitated. Particularly the precleaning discharge unit 26 facilitates the cleaning of the residual toner that is not transferred onto the photoconductive body 3. A light emitting device, such as a laser diode (LD), an LED, an electroluminescence (EL) and fluorescent lamp, may be used for the pretransfer discharge unit 25 and the precleaning discharge unit 26, to expose the photoconductive body 3 by the light emitted therefrom and attenuate the charge on the photoconductive body 3. The LD or EL is preferably used for the light emitting device, and more preferably the EL, which has a relatively simple structure, is used. A precharging discharge unit may be provided on an upstream side of a charging module 4 to carry out a discharge prior to the charging, to erase the residual potential on the photoconductive body 3 and uniformly charge the photoconductive body 3.

Figure 4:
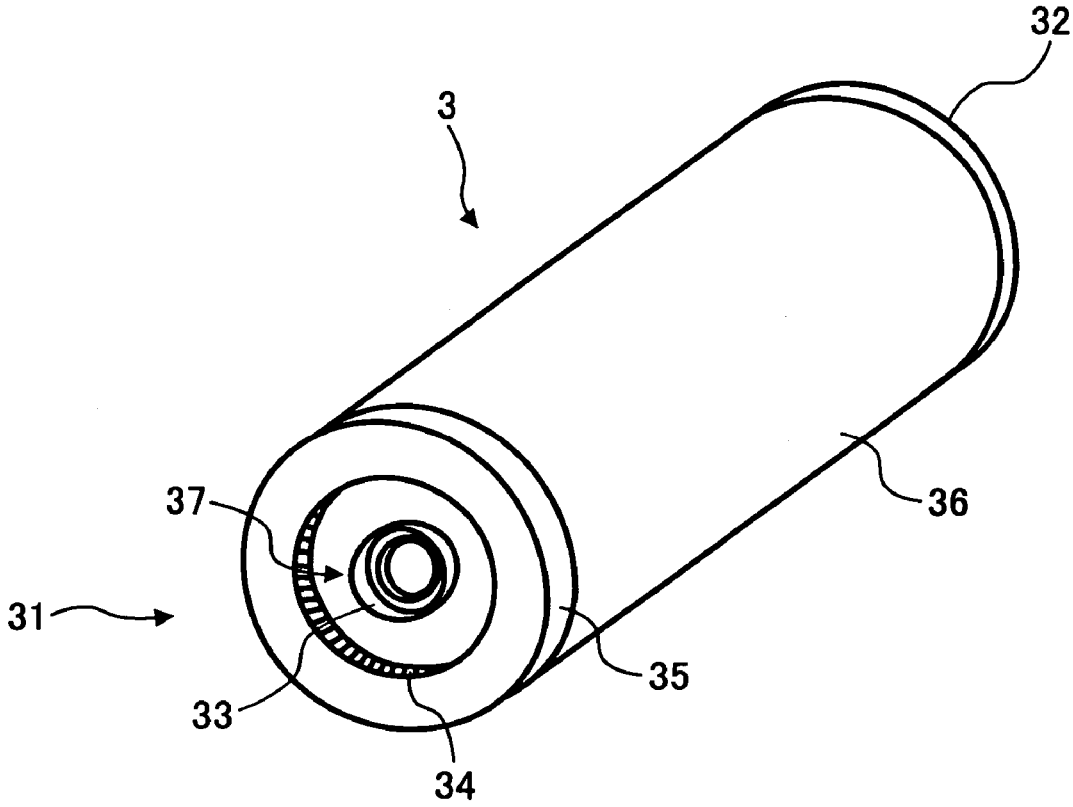
FIG. 4 is a perspective view of a photoconductive body.
Figure 5:
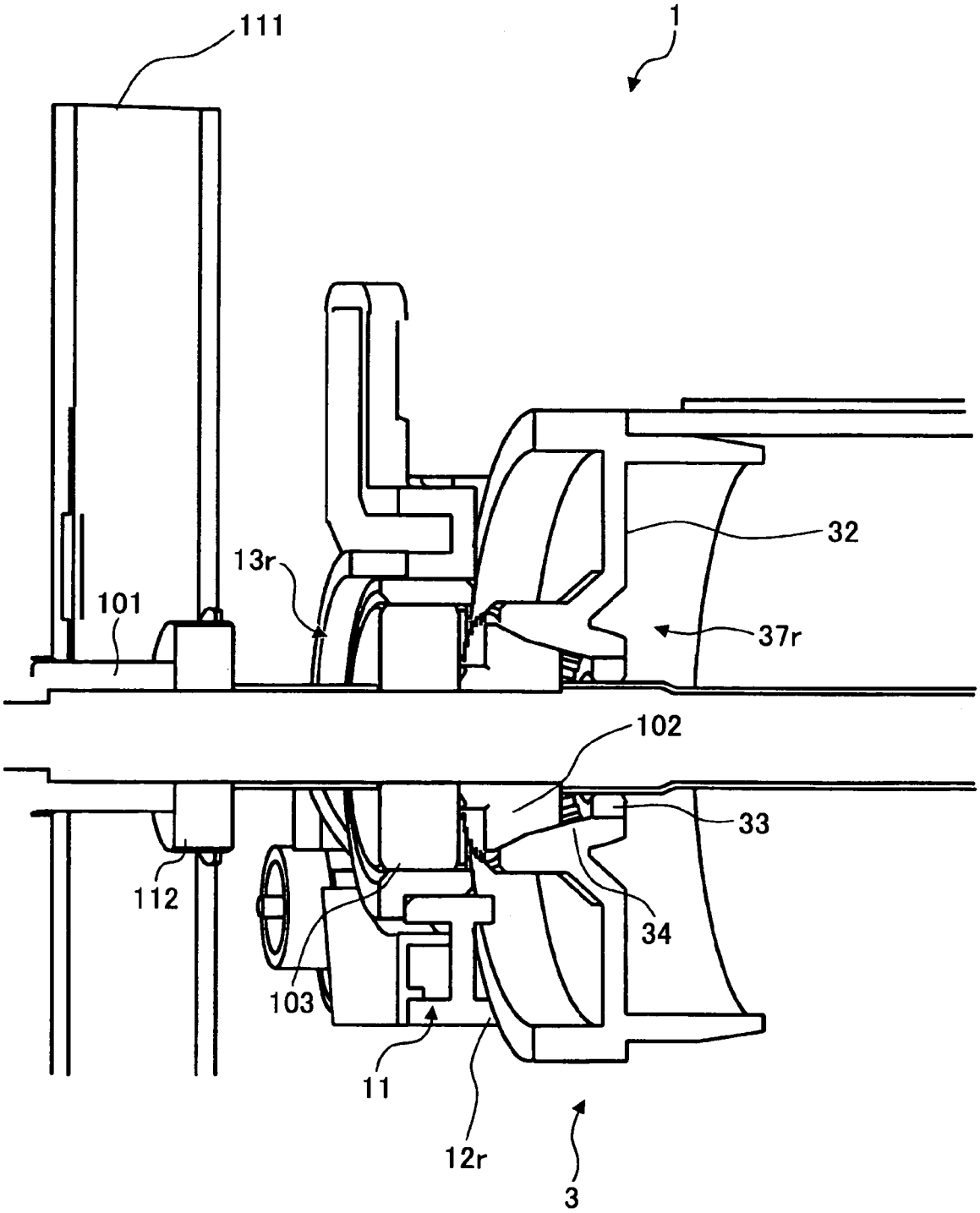
FIG. 5 is a cross section view of a rear side of the process cartridge mounted in image forming apparatus.

FIG. 4 is a perspective view of the photoconductive body. FIG. 5 is a cross section view of a rear side of the process cartridge mounted in image forming apparatus, and FIG. 6 is a cross sectional view of a front side of the process cartridge mounted in the image forming apparatus.

As shown in FIG. 4, the photoconductive body 3 includes a photoconductive layer 6 on a cylindrical aluminum substrate 35. When the photoconductive body 3 has a cylindrical shape, flanges 31 and 32 are provided on both ends on an inner portion of the cylinder.

As shown in FIG. 5, a central part of the flange 32 on the rear side of the process cartridge 1 is formed with a bearing 33 for receiving a driving shaft 101 that is provided in the main body of the image forming apparatus 100. Gears 34 are formed on an inner surface of the bearing 33, and the gears 34 mesh with gears 102 provided on the driving shaft 101.

Figure 6:
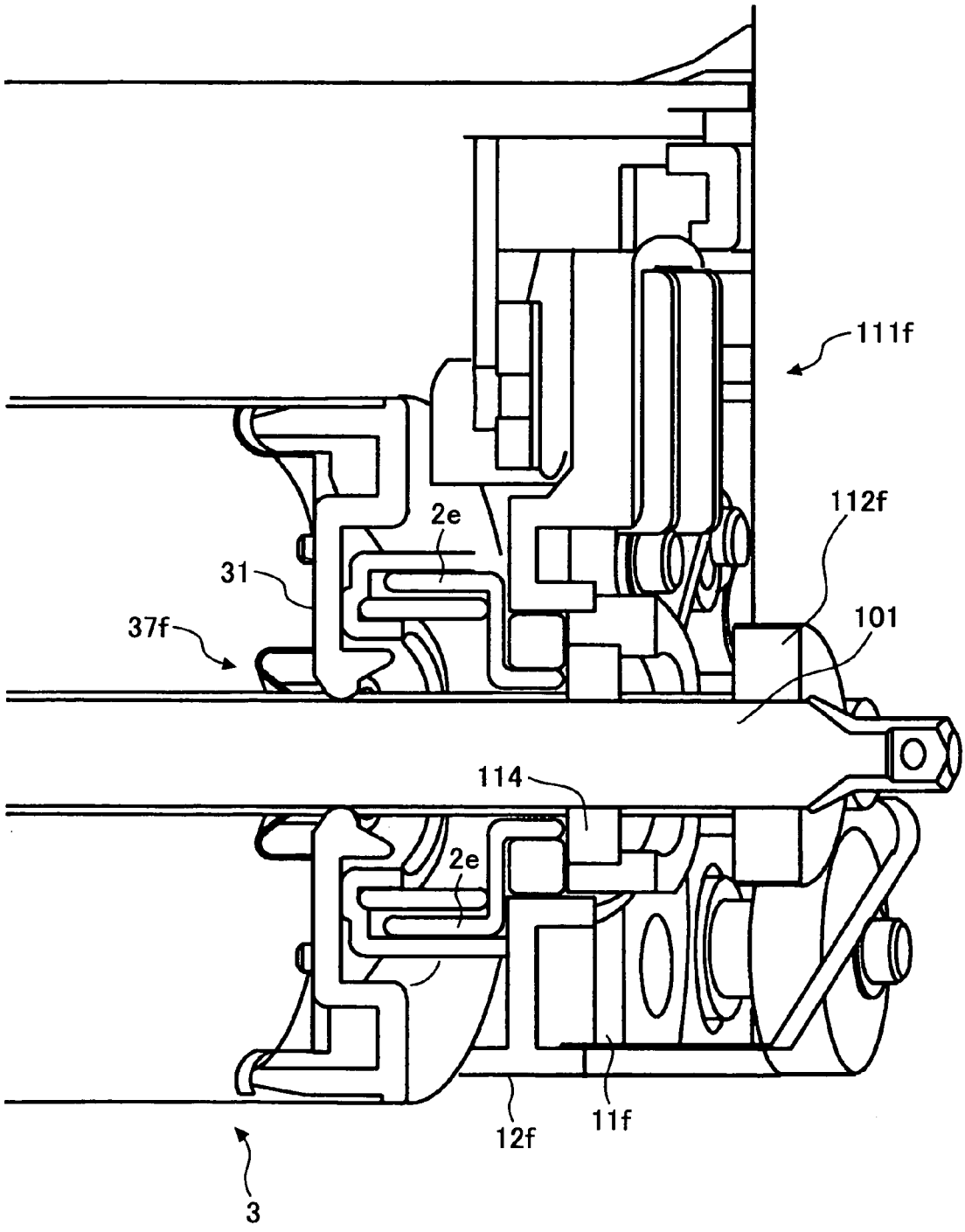
FIG. 6 is a cross sectional view of a front side of the process cartridge mounted in the image forming apparatus.

As shown in FIG. 6, a central part of the flange 31 on the front side of the process cartridge 1 is formed with an engaging part 37*f*. When loading the photoconductive body 3 into the process cartridge 1, the engaging part 37*f* engages a positioning part 2*e* that is mounted on the first frame body 2*a*. The positioning part 2*e* is urged by a spring (not shown) in a direction to push back the photoconductive body 3. The photoconductive body 3 may be loaded into the process cartridge 1 by loading the photoconductive body 3 into the process cartridge frame body 2 while pushing an engaging part 37*r* of the flange 32 against the positioning part 2*e*, and the photoconductive body 3 can be removed (or unloaded) from the process cartridge 1 in a reverse order. When the photoconductive body 3 is simply supported by a support part 12 that is provided on a side plate 11 of the process cartridge frame body 2, the positioning of the photoconductive body 3 is not highly accurate such that the image formation may be carried out in this state. The image forming apparatus 100 includes a bearing 103 on a rear side plate 111*r* of the main body of the image forming apparatus 100, to cooperate with a hole 13 provided in a rear side plate 11*r* of the process cartridge frame body 2 of the process cartridge 1. The driving shaft 101 fits into the hole 13 of the process cartridge 1, to position the image forming apparatus 100 and the process cartridge 1.

The driving shaft 101 is inserted into the bearing 33 of the flange 31 of the photoconductive body 3, and the gears 102 of the driving shaft 101 mesh with the gears 34 of the flange 31. When the driving shaft 101, which is provided in the main body of the image forming apparatus 100, is rotated, the gears 102 of the driving shaft 101 rotate the photoconductive body 3 via the gears 34 of the photoconductive body 3. In addition, the photoconductive body 3 is not fixed on the support part 11 of the process cartridge 1, and is only supported by the support part 11. The photoconductive body 3 is positioned by fitting the driving shaft 101 of the image forming apparatus 100 into the photoconductive body 3. The driving shaft 101 of the image forming apparatus 100 also simultaneously positions the process cartridge 1 and the photoconductive body 3. In order to drive the photoconductive body 3 with a high accuracy, it is effective to support a rotary shaft of the photoconductive body 3, but in this embodiment, the driving shaft 101 is provided in the main body of the image forming apparatus 100, and the driving shaft 101 penetrates and positions the process cartridge 1. Consequently, it is possible to make the photoconductive body 3 and the process cartridge 1 inexpensive, and also rotationally drive the photoconductive body 3 and the process cartridge 1 with a high accuracy.

Figure 7:
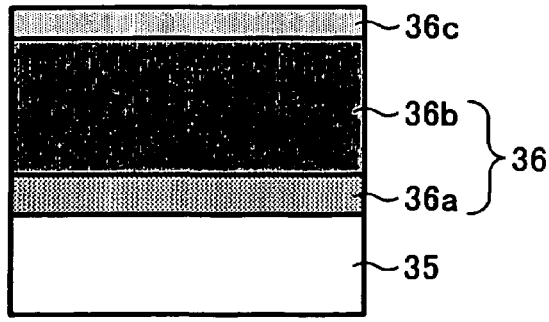
FIG. 7 is a cross sectional view of photoconductive layers of the photoconductive body.

FIG. 7 is a cross sectional view of photoconductive layers of the photoconductive body.

As shown in FIG. 7, a substrate 35 of the photoconductive body 3 can be formed from a metal, such as aluminum, copper and/or steel, and/or alloys of these metals. The substrate 35 is formed into a generally cylindrical pipe shape by subjecting the metal or metal alloy to a process such as extruding and/or drawing, and is then subjected to a surface processing such as cutting, superfinishing and/or polishing to form a cylindrical drum.

A photoconductive layer 36 is formed by a charge generating layer 36*a*, which has a charge generating material as a main component, and a charge transfer layer 36*b* which transfers the generated charge to the surface of the photoconductive body 3 or the substrate 35. The charge generating layer 36*a* may be formed by scattering or disposing the charge generating material within a suitable solvent, together with a binding resin if desired, by use of a ball mill, an attriter, sand mill, ultrasonic wave or the like, and coating the charge generating material on a conductive support to be dried thereon. A known charge generating material may be used for the charge generating layer 36*a*. Examples of suitable charge generating materials for the charge generating layer 36*a* include mono azo pigment, di azo pigment, tris azo pigment, perylene-based pigment, perynone-based pigment, quinacridone-based pigment, quinone-based condensed polycyclic compound, squalic acid-based dye, phthalocyanine-based pigment, naphthalocyanine-based pigment and azulnenium salt based dye. The azo pigment and/or the phthalocyanine-based pigment are particularly suited for use as the charge generating material.

The charge transfer layer 36*b* may be formed by dissolving or scattering a charge generation (or transport) material and a binding resin into a suitable solvent, and coating the charge generation material on the charge generating layer 36*a* to be dried thereon. A plasticizer, a leveling agent, an antioxidant or the like may be added to the charge generation material if desired. The charge generation material may be categorized into a hole generation (or transport) material and an electron generation (or transport) material. For example, the charge generation material can include chloranyl, bromanyl and tetracyanoethylene, and the hole generation material can include poly-N-vinylcarbazole and its derivative, poly-γ-carbazoleethylglutamate and its derivative, pyrene-formaldehyde condensed material and its derivative, polyvinylpyrene and polyvinylphenanthrene.

A protection layer 36*c* may be provided on the photoconductive layer 36 to protect the photoconductive layer 36. A filler may be added to the protection layer 36*c* for the purposes of improving the wear (or abrasion) resistance. From the point of view of the hardness of the filler, it is advantageous to use an inorganic filler material. Silica, titanium oxide and alumina are particularly effective when used as the inorganic filler material.

Figure 8A:
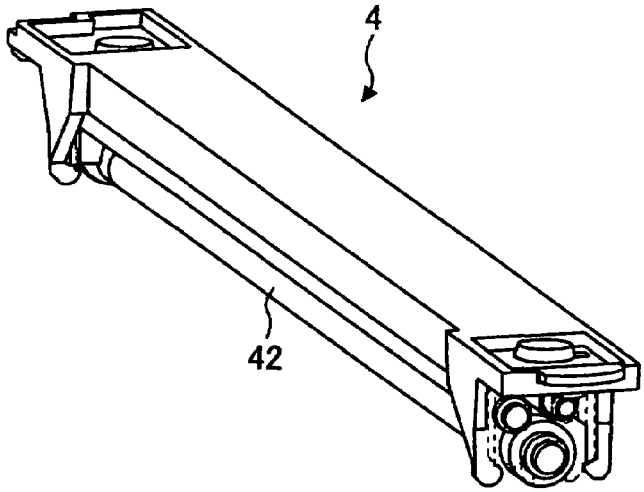
FIGS. 8A and 8B are perspective and side views showing a charging module.
Figure 8B:
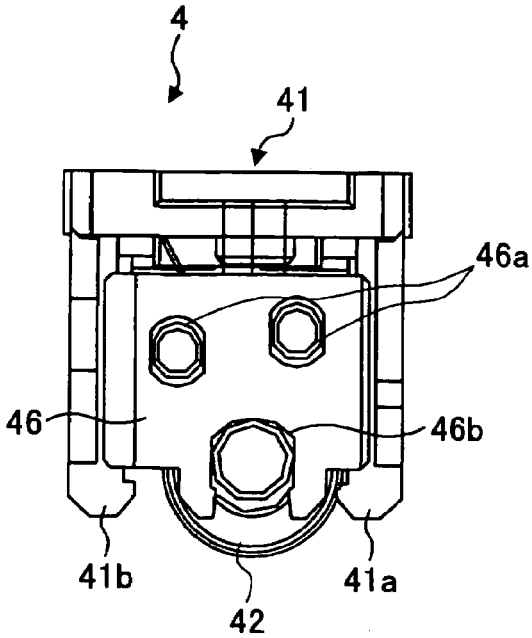
Figure 9:
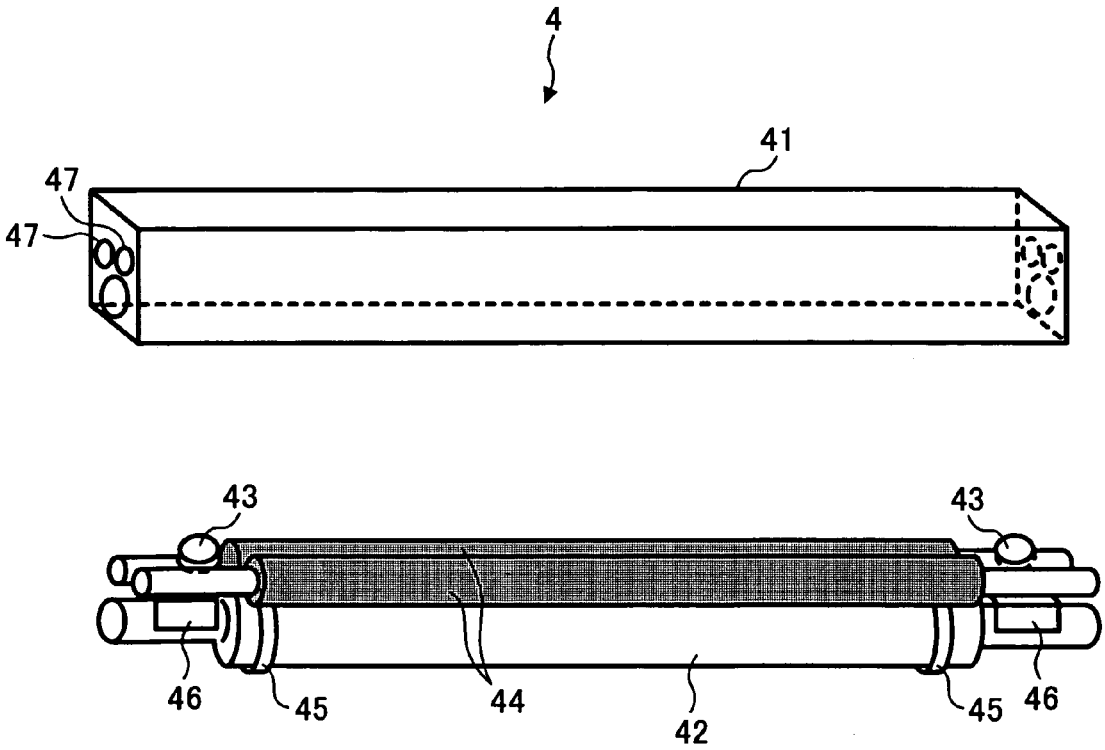
FIG. 9 is a perspective view of the charging module.

FIGS. 8A and 8B are perspective and side views of the charging module. FIG. 9 is a perspective view of the charging module. As shown in the figures, the charging module 4 includes a charging member 42 which is disposed to confront the photoconductive body 3, charging cleaning rollers 44 which prevent the charging member 42 from vibrating and cleans dirt on spring members 43 and the charging member 42, spacer members 45, support members 46. A housing 41 accommodates the charging member 42, spring members 43, charging cleaning rollers 44, spacer members 45, and support members 4. The charging member 42 and the charging cleaning rollers 44 are rotatably supported by the support members 46. The support members 46 are pushed or urged by the spring members 43 in a direction to separate from the housing 41 (e.g., in a direction towards the rotary axis of the photoconductive body 3), and movements thereof are restricted by restricting members 41*a* formed on the housing 41. By using the above described structure, when the charging module 4 is loaded into the process cartridge 1, the charging member 42 maintains a predetermined distance from the photoconductive body 3 by the provision of the spacer members 45, and in addition, the charging member 42 is prevented from vibrating. The charging module 4, which forms the charting device or unit, is independently replaceable regardless of the loaded or unloaded state of the photoconductive body 3.

Figure 10:
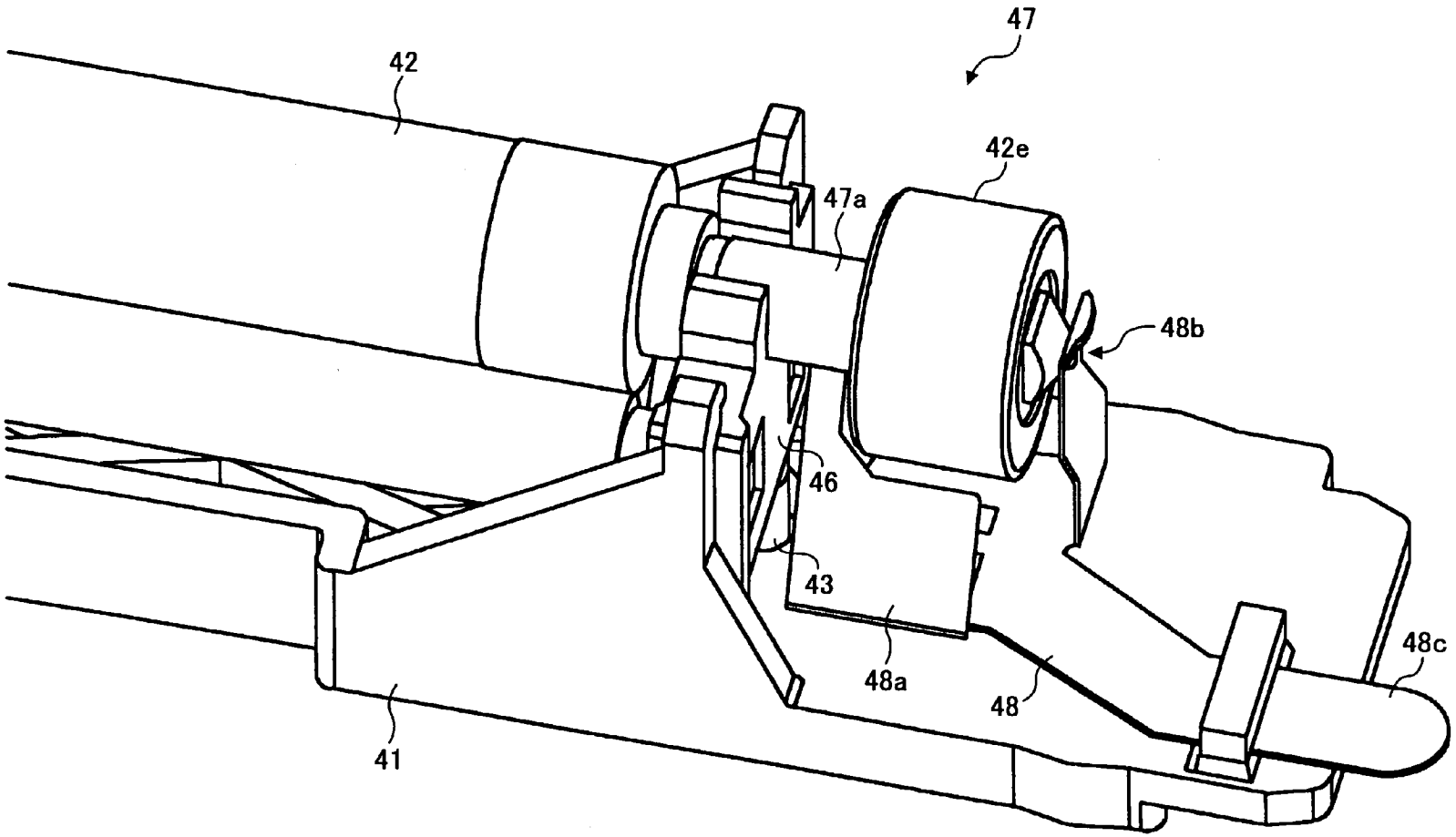
FIG. 10 is a detail view of an electrode part contacting a charging member of the charging module.

FIG. 10 is a detail view of an electrode part contacting the charging member of the charging module. An electrode part 47 is provided on the housing 41 of the charging module 4. The electrode part 47 has a bearing 47*a* rotatably supporting the roller-shaped charging member 42, and a power supply terminal 48 which includes a contact type power supply part 48*c* which connects to a high voltage supply (not shown) provided externally to the process cartridge 1.

The power supply terminal 48 extends along the housing 41 of the charging module 4 in a direction from the contact type power supply part 48*c* towards the charging member 42. A slider type power supply part 48*a* is provided on one end of the power supply terminal 48, and is configured to supply power to a shaft of the charging member 42 while making sliding contact with an outer peripheral surface of this shaft in a state urged against this shaft by the resiliency of the material forming the power supply terminal 48. On the other hand, a slider type power supply part 48*b* is provided on the other end of the power supply terminal 48, and is configured to supply power to the shaft of the charging member 42 while making sliding contact with an end surface of this shaft in a state urged against the end surface of this shaft by the resiliency of the material forming the power supply terminal 48. At least one of the slider type power supply parts 48*a* and 48*b* can be provided. However, it is possible to more positively supply the power by supplying the power via a plurality of parts, when both the slider type power supply parts 48*a* and 48*b* are provided.

A gear 42*e* is fixed on the shaft portion of the charging member 42. When the charging module 4, described below, is loaded into the process cartridge 1, the gear 42*e* engages a driving mechanism (not shown) which rotates the charging member 42 via the gear 42*e*. The support member 46 has a support part 46*b* which supports the shaft of the charging member 42. The support member 46 is movable vertically in FIG. 8B along a guide part 41*b* which is provided on the housing 41. The spring member 43 is provided as an urging part between the support member 46 and the housing 4. The support member 46 is pushed by the spring member 43 in the direction to separate from the housing 41, that is, in the direction towards the rotary axis of the photoconductive body 3, and the movement of the support member 46 is restricted by the restricting part 41*a* which is formed on the housing 41. By using the above described structure, the charging member 42 maintains a predetermined distance from the photoconductive body 3 by the provision of the spacer member 45, and the charging member 42 is also prevented from vibrating, when the charging module 4 is loaded into the process cartridge 1. Moreover, when removing the charging module 4, it is possible to handle the charging module 4 by itself.

A cleaning mechanism, which contacts and cleans the surface of the charging member 42, is disposed in the housing 41 of the charging module 4. In this embodiment, the charging cleaning rollers 44 are provided as the cleaning mechanism. The charging cleaning rollers 44 shown in FIG. 9 are inserted into support parts 46*a* which are provided in the side plates of the housing 41 of the charging module 4 shown in FIG. 8B, and are rotatably supported by the support parts 46*a*. The charging cleaning rollers 44 contact the charging roller 42 and clean the outer peripheral surface of the charging roller 42. When foreign particles, such as the toner, paper dust and broken pieces of members adhere on the surface of the charging roller 42, an abnormal discharge may occur. However, such an abnormal discharge can be prevented by cleaning the surface of the charging roller 44 by the charging cleaning rollers 42. Preferably, the charging cleaning rollers 44 have a roller shape shown in FIG. 9 and clean the surface of the charging roller 42 while rotating. Each charging cleaning roller 44 contacts the charging member 42 due to its own weight. However, each cleaning roller 44 may contact the charging member 42 by being urged by a spring or by being applied with a weight. The charging cleaning rollers 44 may be formed by a brush member or a continuous porous member.

The gap between the charging member 42 and the photoconductive body 3 is 100 μm or less or, preferably from 20 μm to 50 μm, by the spacer member 45. By maintaining this gap, it is possible to prevent the formation of an abnormal image when the charging module 4 operates. The gap may be adjusted by a fitting part 15 which fits the process cartridge 1 and the charging module 4. The charging roller 42 is pushed in the direction towards the surface of the photoconductive body 3 by the spring member 43 which is provided on a bearing made of a resin having a low coefficient of friction. Consequently, the above gap can be maintained constant even if mechanical vibrations occur or the core metal deviates.

Figure 11:
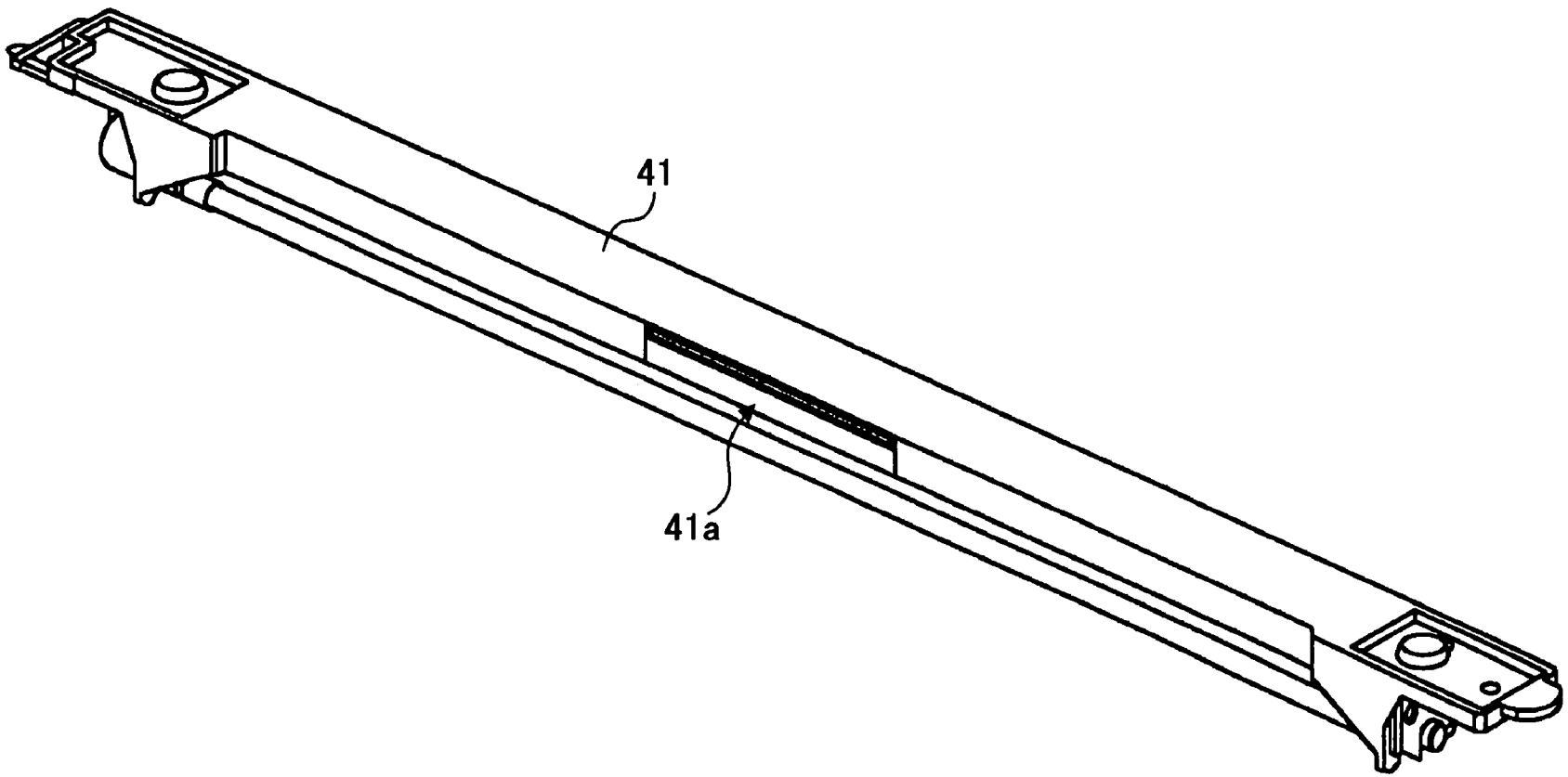
FIG. 11 is a perspective view of the charging module.

FIG. 11 is a perspective view of the charging module. As shown in FIG. 11, a handle 41*a* is provided approximately at the center part of the housing 41 of the charging module 4. The handle 41 is formed by a change in geometrical configuration, such as a convex part and/or a concave part, provided on a part of the housing 41, to facilitate the handling of the charging module 4 by itself.

Figure 12:
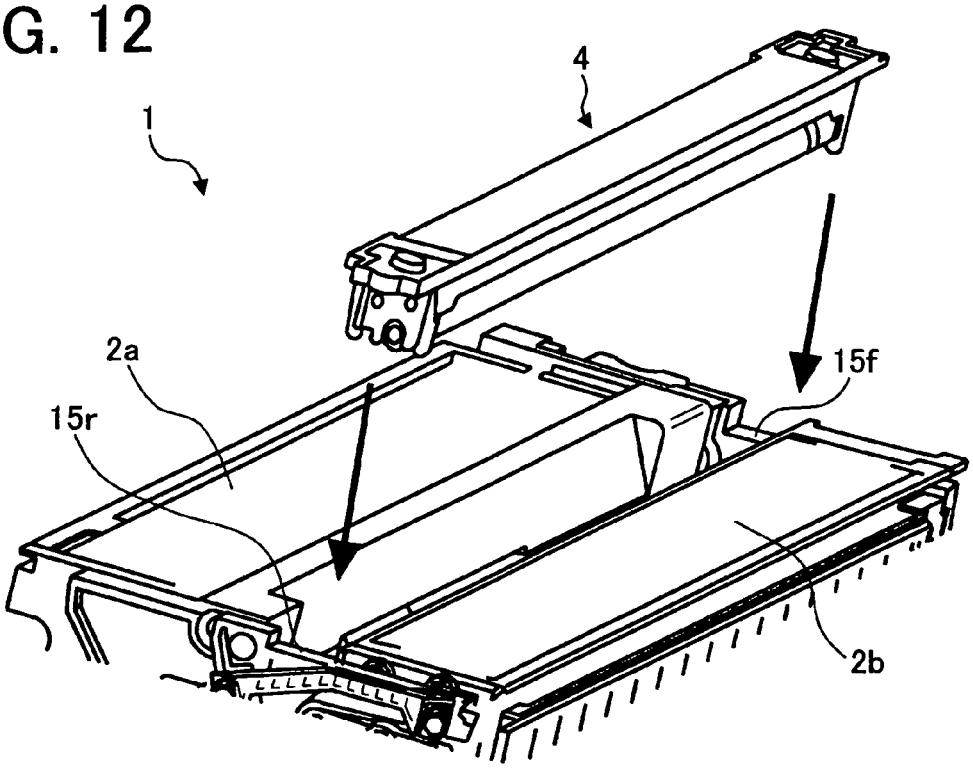
FIG. 12 is a perspective view showing the charging module loaded in the process cartridge.

FIG. 12 is a perspective view showing the charging module loaded in the process cartridge. As shown in the figure, the charging module 4 is inserted between fitting parts 15*f* and 15*r* provided on side plates 11*f* and 11*r* of the process cartridge 1. The charging module 4 is positioned by being fitted between the fitting parts 15*f* and 15*r*, and is fixed on the second frame body 2*b*. The reference character "f" included with the reference numerals "11" and "15" indicates the front side of the process cartridge 1, and the reference character "r" included with the reference numerals "11" and "15" indicates the rear side of the process cartridge 1.

Figure 13:
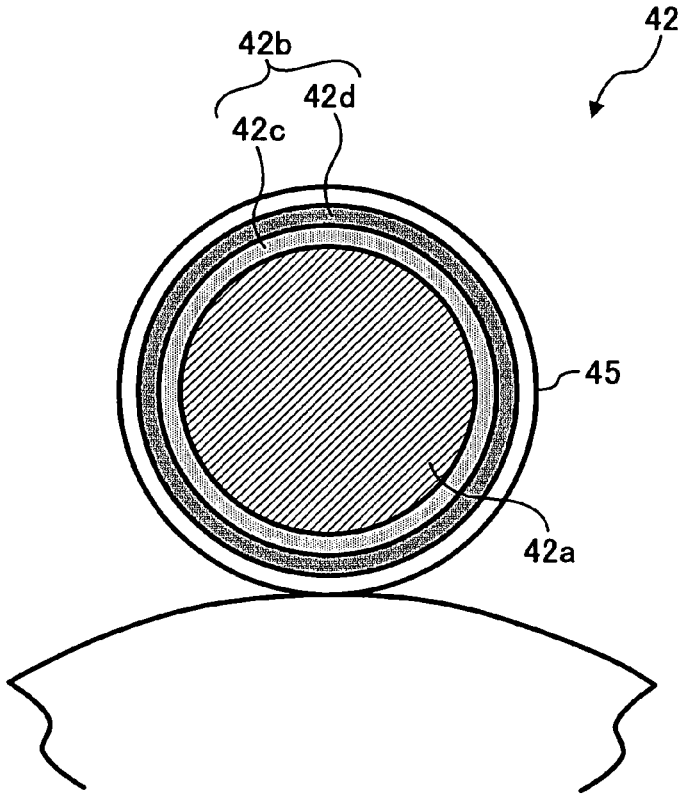
FIG. 13 is a diagram showing the charging member.

FIG. 13 is a diagram showing the charging member. The charging member 42 of the charging module 4 may have any suitable structure, but the roller shape is preferable. The charging member 42 shown in FIG. 13 includes a shaft part 42*a* made of a core metal and provided at the center, and a main body part 42*b*. The main body part 42*b* includes an intermediate resistor layer 42*c* provided around the shaft part 42*a*, and a surface layer 42*d* provided around the intermediate resistor layer 42*c* and forming the outermost layer. For example, the shaft part 42*a* is formed from a metal, such as stainless steel and aluminum, having a high rigidity and high conductivity, with a diameter from 8 mm to 20 mm. Alternatively, the shaft part 42*a* is formed from a conductive resin or the like having a high rigidity and a volume resistivity of $1\times10^3$ Ω·cm or less, and preferably of $1\times10^2$ Ω·cm or less. Preferably, the intermediate resistor layer 42*c* has a thickness from approximately 1 mm to 2 mm and a volume resistivity from $1\times10^5$ Ω·cm to $1\times10^9$ Ω·cm. Preferably, the surface layer 42*d* has a thickness of approximately 1 μm and a volume resistivity from $1\times10^6$ Ω·cm to $1\times10^{12}$ Ω·cm. It is preferable that the volume resistivity of the surface layer 42*d* is higher than the electrical resistivity of the intermediate resistor layer 42*c*. Although the main body part 42*b* of this embodiment has a two-layer structure made up of the intermediate resistor layer 42*c* and the surface layer 42*d*, the main body part 42*b* is not limited to such a structure, and the main body part 42*b* may be formed by a single-layer structure or a multi-layer structure such as a three-layer structure.

Figure 14A:
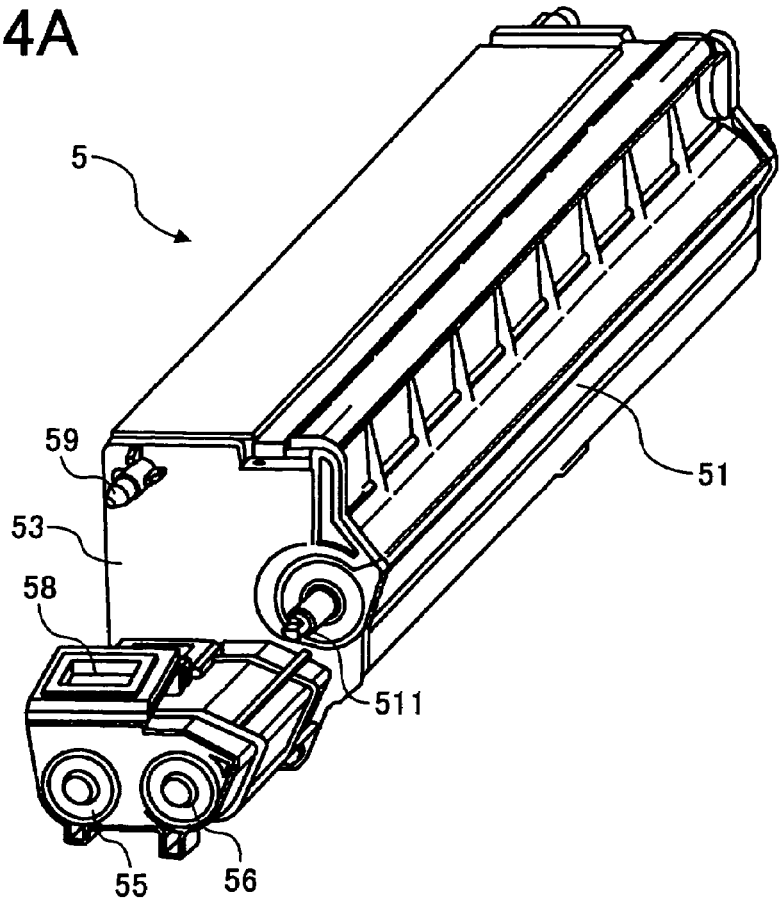
FIGS. 14A and 14B are perspective and side views of a developing module.
Figure 14B:
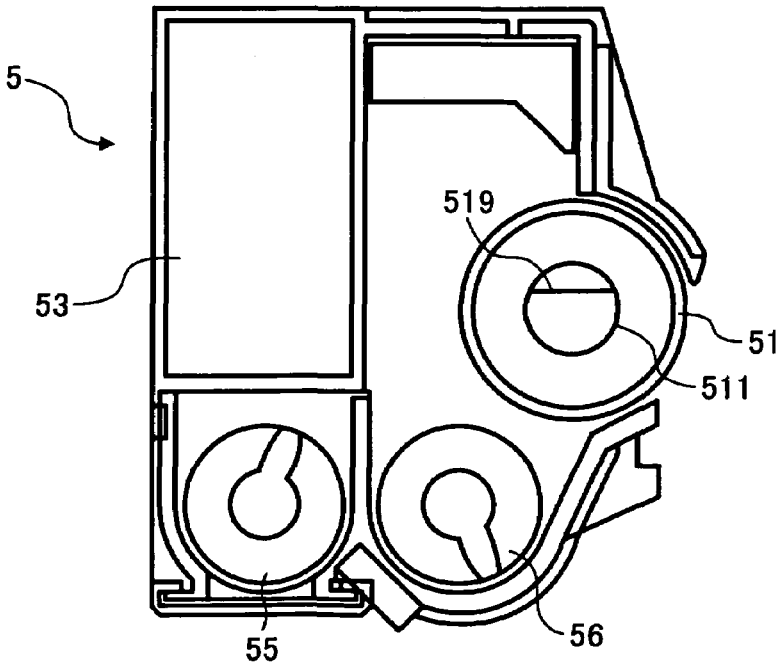
Figure 16:
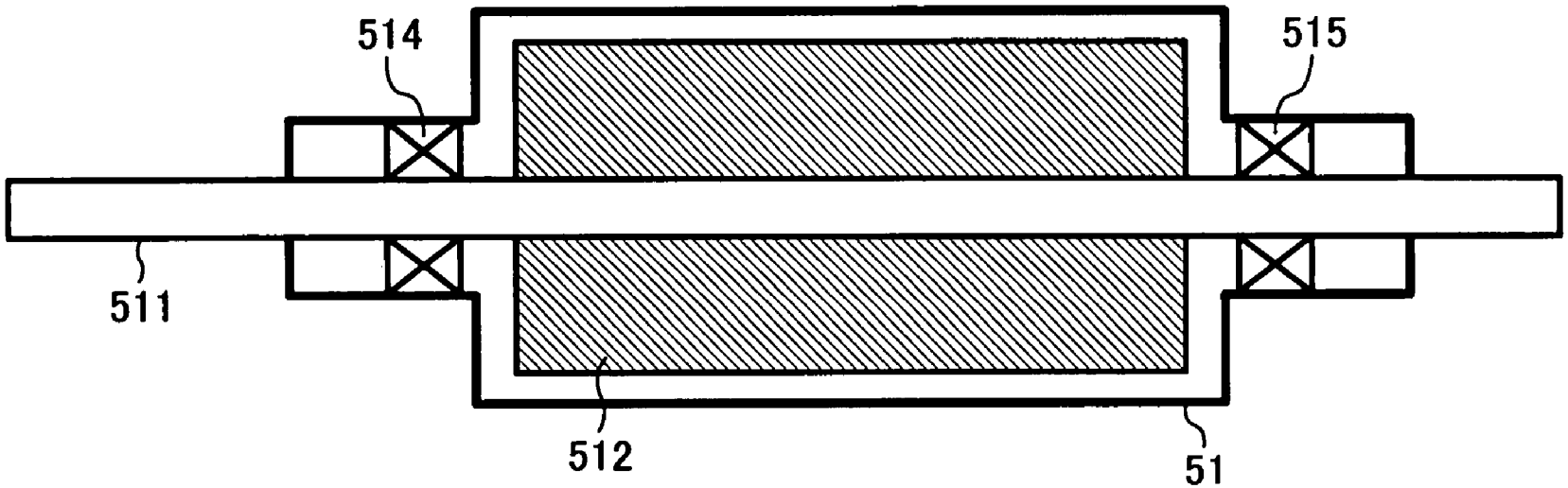
FIG. 16 is a cross sectional view of a developing sleeve.

FIGS. 14A and 14B are perspective and side views of the developing module. The developing module 5 is loaded into the first frame body 2*a* as shown in FIG. 1. The developing module 5 includes a developing sleeve 51 which is disposed close to the photoconductive body 3 and forms a developer bearing member, a magnet group 512 as shown in FIG. 16 (described below) that rotates the developing sleeve 51, a rotatable shaft 511 provided at the end part of a rotary axis of the magnet group 512 and having a D-shaped cross section 519 as an engaging portion for determining an angle of a main pole direction (described below), a projecting guide 59, a supply opening 58 through which the toner is supplied from a toner container (not shown) which is provided separately from the developing module 5, a mixing screw 55 for mixing and agitating the supplied toner, and a supply roller 56 for supplying the mixed developing agent to the developing sleeve 51. The above described structure of the developing module 5 enables the developing agent to be supplied to the photoconductive body 3. The magnet group 512 has a predetermined main pole direction indicating a maximum value of a magnetic flux density distribution, and the magnet group 512 is positioned with respect to the photoconductive body 3 with the angle of the main pole direction determined depending on the process conditions of each individual image forming apparatus 100.

Figure 15:
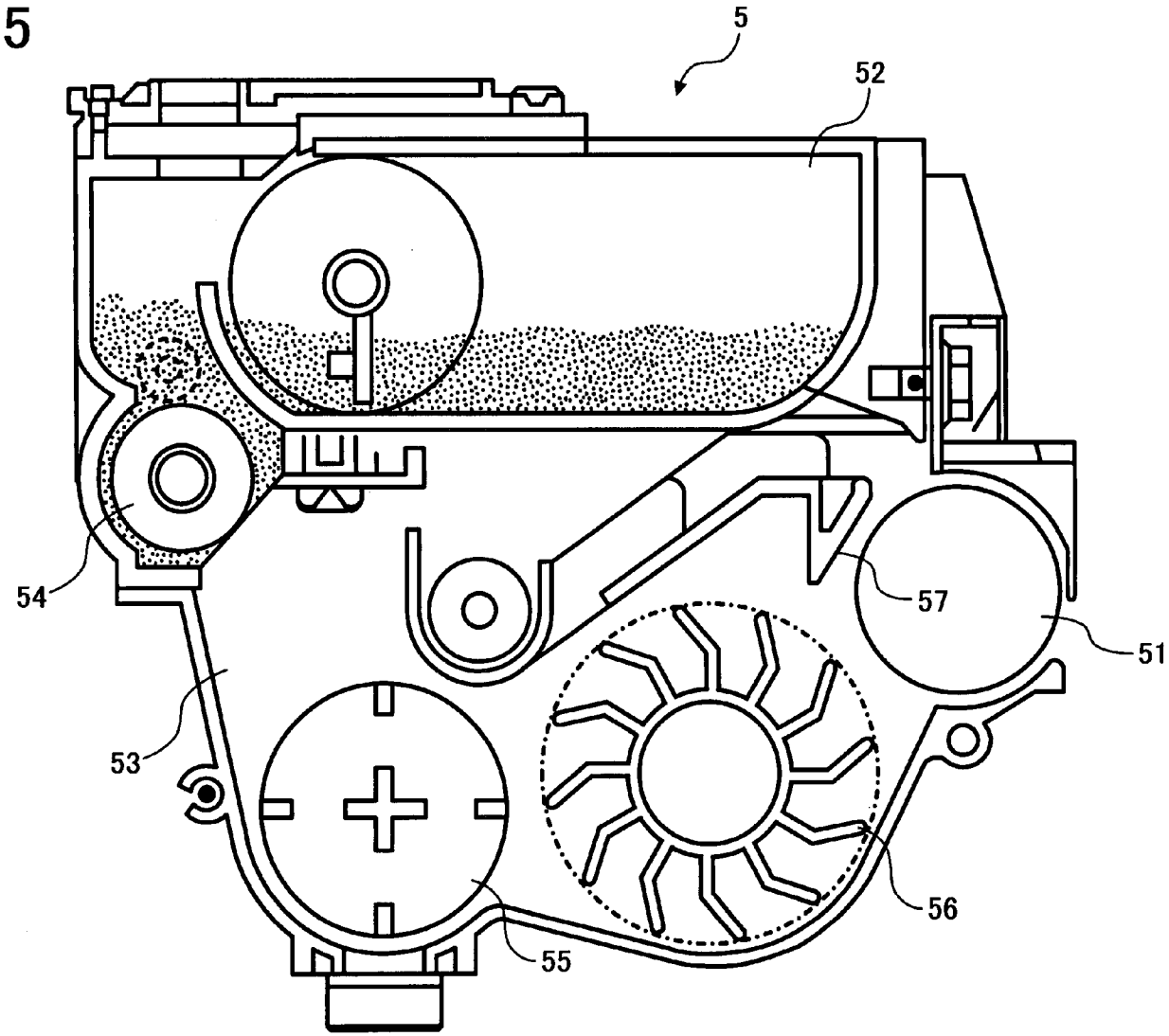
FIG. 15 is a cross sectional view of the developing module.

FIG. 15 is a cross sectional view of the developing module. The developing module 5 includes a toner hopper 52 for accommodating the toner that is to be supplied, a supply roller 54 for supplying the toner from the toner hopper 52 to a developing agent accommodating part 53, a mixing screw 55 for mixing and agitating the supplied toner and magnetic carriers, a supply roller 56 for supplying the mixed developing agent to a developing sleeve 51, and a restricting member 57 for restricting the amount of developing agent supplied to the developing sleeve 51.

When the developing sleeve 51 rotates, the restricting member 57 that is disposed on an upstream side of a developing region in a transport direction of the developing agent restricts the ear height of the ear of the developing agent chain, that is, the amount of developing agent on the developing sleeve 51. The restricting member 57 and the developing sleeve 51 are accurately positioned to accurately determine a gap between the restricting member 57 and the developing sleeve 51 in the developing region, so that it is possible to form a high-quality image.

FIG. 16 is a cross sectional view of the developing sleeve. The developing sleeve 51 shown in FIG. 16 has a cylindrical shape and is formed from a nonmagnetic material, such as aluminum, brass, stainless steel and/or conductive resin. The developing sleeve 51 is driven around the rotatable shaft 511 by a rotary driving mechanism (not shown). The magnet group 512 exerts a magnetic force sufficient to attract the magnetic carriers onto the surface of the developing sleeve 51. The rotatable shaft 511 is provided at the center of the magnet group 512 and rotates the magnet group 512. The rotatable shaft 511 is supported by bearings 514 and 515 disposed on end parts of the developing sleeve 51, and is rotatable independently of the developing sleeve 51 to enable adjustment of the main pole direction.

Figure 17:
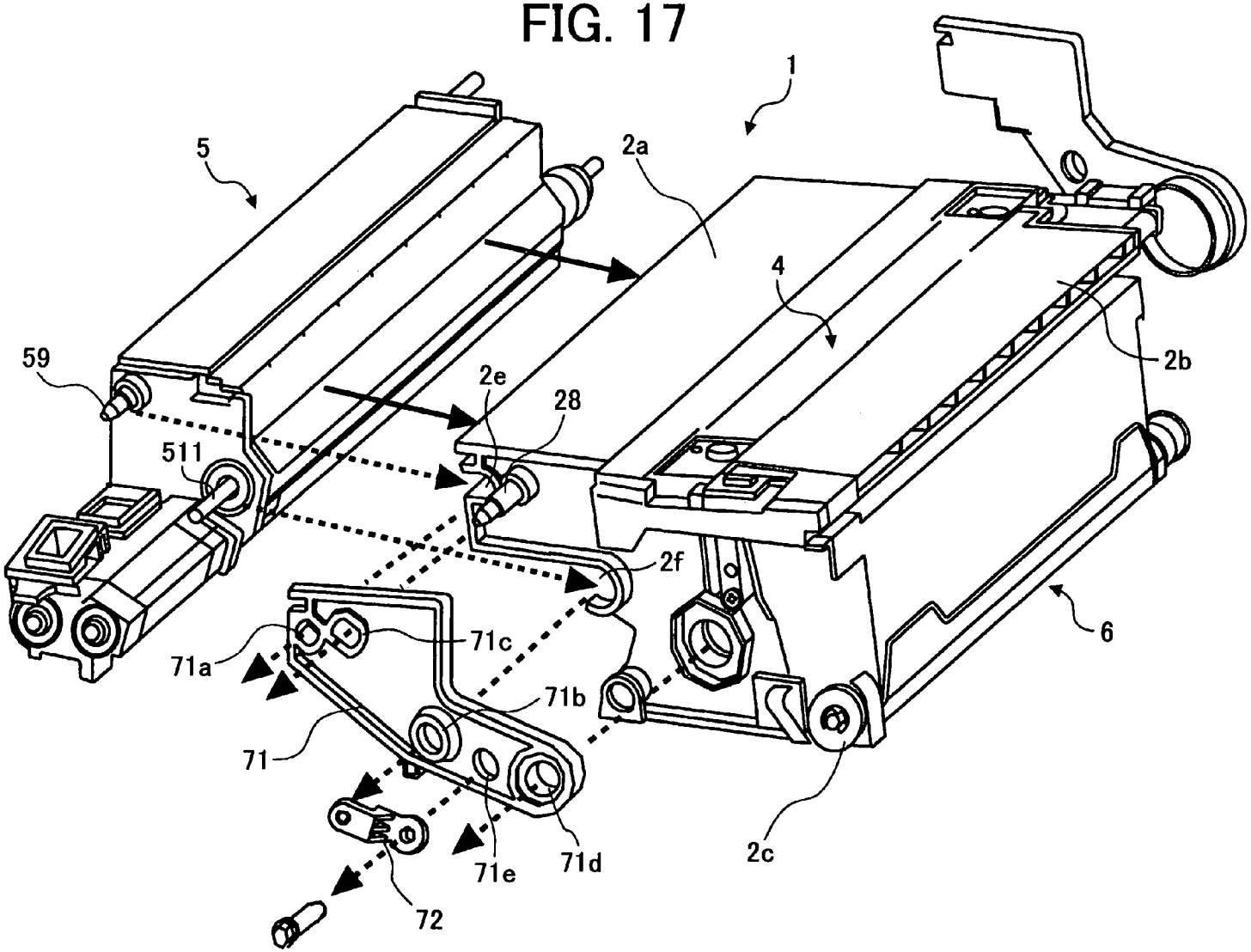
FIGS. 17 and 18 are perspective views of the loaded developing module.
Figure 18:
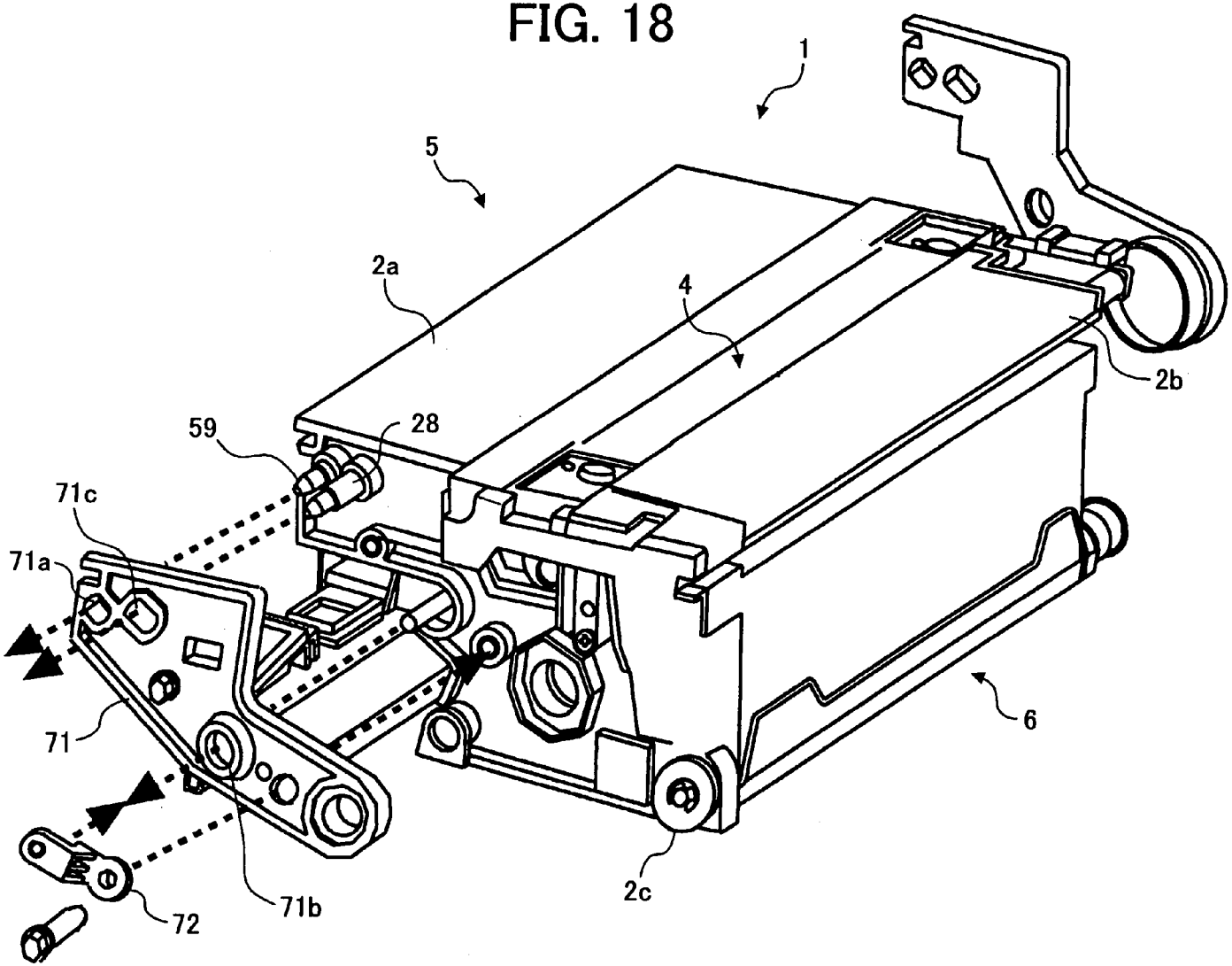

FIGS. 17 and 18 are perspective views of the loaded developing module. The developing module 5 is loaded into the first frame body 2*a* and positioned by positioning members 71 and angular positioning members 72 which respectively form developing position determining members. As shown in FIGS. 17 and 18, when loading the developing module 5 into the first frame body 2*a*, the projecting guides 59 of the developing module 5 are fitted into guide grooves 2*e* provided in the first frame body 2*a*, the projecting guides 59 are inserted into holes 71*a* of the positioning member 71, projecting guides 28 formed on the first frame body 2*a* are inserted into holes 71*c* of the positioning members 71, and the rotatable shaft 511 is inserted into holes 71*b* of the positioning members 71, to support the developing sleeve 51 in a rotational state where the outer peripheral surface of the developing sleeve 51 is positioned with respect to the surface of the photoconductive body 3.

Figure 19:
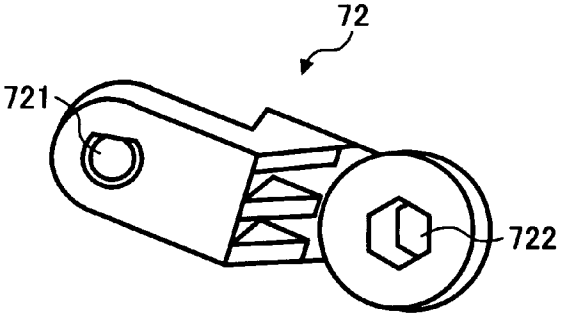
FIG. 19 is a perspective view of an angular position determining member.

FIG. 19 is a perspective view of the angular position determining member. Each end part of the rotatable shaft 511 can penetrate the hole 71*b* of the positioning member 71 and fit into a D-shaped hole (or bearing) 721 in the angular positioning member 72, as shown in the figure. Because the end part of the rotatable shaft 511 has the D-shaped cross section, the rotatable shaft 511 is positioned to a predetermined angular position (or rotary position) and is prevented from rotating by engaging the D-shaped hole 721. The end part of the rotatable shaft 511 is not limited to the D-shaped cross section, and the hole 721 is not limited to the D-shape, as long as it is possible to prevent the rotatable shaft 511 from rotating and to position the rotatable shaft 511 to the predetermined angular position. The main pole direction of the magnet group 512 with respect to the photoconductive body 3 can be adjusted by the angular positioning member 72. Further, by fixing the angular positioning member 72 on the positioning member 71 by a screw which penetrates a fixing hole 722 in the angular positioning member 72, it becomes possible to fix the main pole direction at the adjusted position.

In addition, the driving shaft 101 of the photoconductive body 3 of the image forming apparatus 100 penetrates holes 71*d* in the positioning members 71. As a result, it is possible to position the photoconductive body 3 and the developing module 5 relative to each other. The positioning members 71 can be used as a main reference for the positioning of the photoconductive body 3 and the developing sleeve 51, and a gap (or developing gap) between the developing sleeve 51 and the photoconductive body 3 may be adjusted based on this main reference.

Therefore, the developing module 5 can simply be positioned with a high accuracy with respect to the process cartridge 1, by determining the angular position of the magnet group 512 with respect to the photoconductive body 3 and determining the position of the developing sleeve 51 with respect to the photoconductive body 3. Particularly in the case of the replaceable developing module 5, the gap between the photoconductive body 3 and the developing sleeve 51 may greatly affect the image quality of the image that is formed, and it is important to accurately maintain this gap even after the developing module 5 is replaced by another developing module 5. Because the main pole direction is determined by the angular positioning member 72 after determining the developing gap by positioning the developing sleeve 51 and the photoconductive body 3 by the positioning members 71, the developing module 5 can be positioned with a high accuracy with respect to the photoconductive body 3. In this embodiment, this accurate positioning can be maintained by the provision of the D-shaped hole (or bearing) 721 in the angular positioning member 72.

The projecting guide 59 of the developing module 5 fits into the guide part 2*e* of the first frame body 2*a*, and the rotatable shaft 511 fits into the guide part 2*f* of the first frame body 2*a*, on each side of the process cartridge frame body 2. The projecting guide 59 of the developing module 5 and the projecting guide 28 of the first frame body 2*a* fit into the respective holes 71*a* and 71*c* of the positioning member 71, while the rotatable shaft 511 fits into the hole 71*b* of the positioning member 71. Thus, the projecting guide 59 of the developing module 5 forms a part that is to be positioned with respect to the positioning reference, and the projecting guide 28 of the first frame body 2*a* forms a part that is to be positioned with respect to the positioning reference, so that a stable rotation of the magnet group 512 and the like can be realized within the developing module 5. The projecting guides 59 and 28 may have a D-shaped cross section, and the corresponding holes 71*a* and 71*c* in the positioning member 71 may have a D-shape, so that the developing module 5 and the process cartridge frame body 2 can be positioned with a high accuracy relative to each other.

The developing module 5 can easily be separated from the process cartridge frame body 2 by removing the angular positioning members 72 and the positioning members 71 in a reverse order to that described above.

In this embodiment, the developing module 5 uses the dry type two-component developing agent. However, the developing module 5 is not limited to the dry type two-component developing agent, and recycled toner may be used for the dry type developing agent. In addition, the developing module 5 may use a single-component magnetic developing agent or a single-component nonmagnetic developing agent.

The developing module 5 may be provided with the supply opening 58 for supplying the toner, as in the case of this embodiment. The process cartridge 1 is shipped with the supply opening 58 is sealed by a seal, a lid or the like, and the supply opening 58 is first opened when using the process cartridge 1. After the supply opening 58 is opened and the toner within the process cartridge 1 is used, the toner may be supplied to the process cartridge 1 via the supply opening 58 when the amount of toner within the process cartridge 1 becomes low, to enable the process cartridge 1 to be used again. The process cartridge 1 may accommodate the newly supplied toner within the developing agent accommodating part 53. The toner that is supplied may be newly supplied or, may be recovered toner for reuse. An accommodating part for accommodating the toner that is to be supplied may be provided in the main body of the image forming apparatus 100. In addition, such an accommodating part may be provided within the process cartridge 1. In such cases, the developing module 5 can be used repeatedly without having to replace the developing module 5, by supplying the toner to the developing module 5 when desired.

Figure 20:
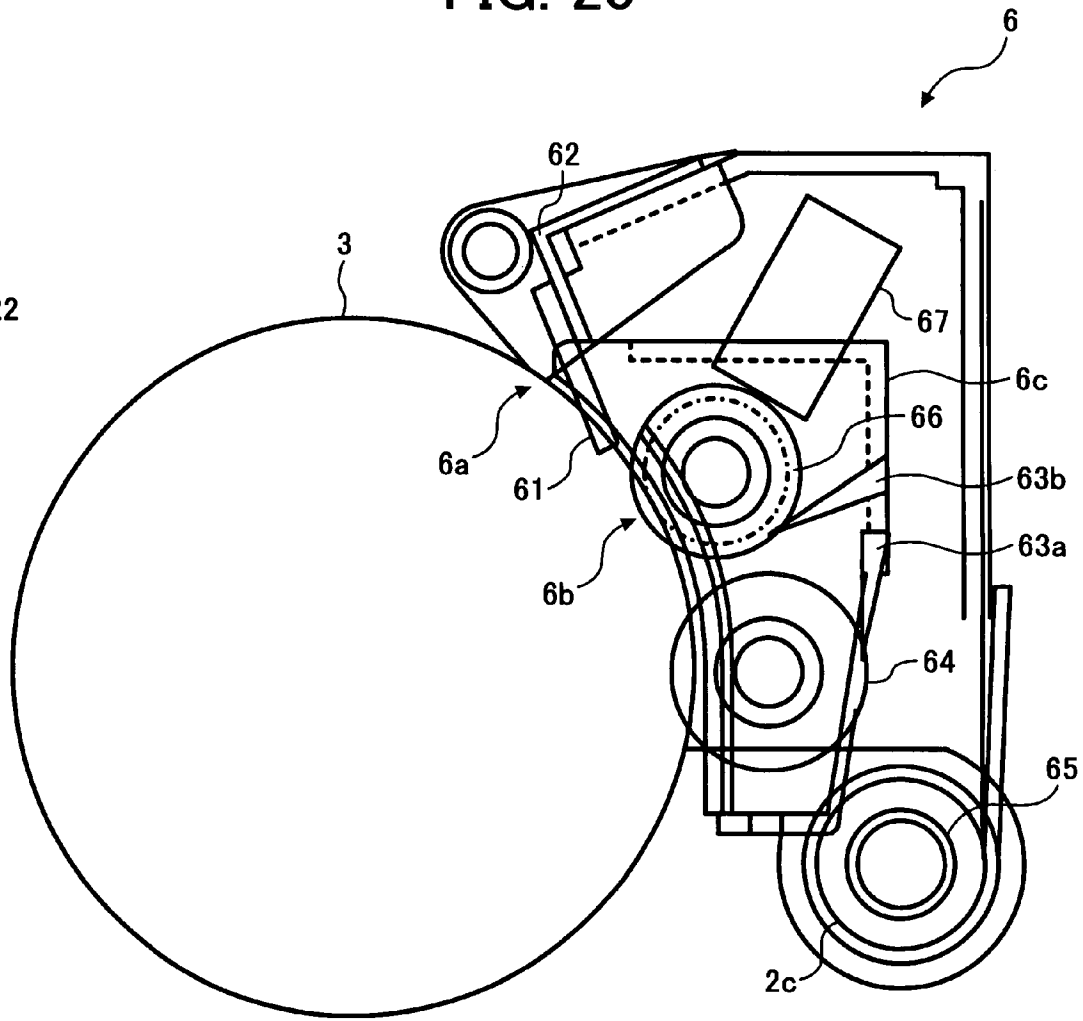
FIG. 20 is a cross sectional view of a cleaning module.

FIG. 20 is a cross sectional view of the cleaning module. The cleaning module 6 includes a cleaning mechanism 6*a* and a coating mechanism 6*b*. The cleaning mechanism 6*a* cleans the photoconductive body 3. The cleaning mechanism 6*a* includes a cleaning blade 61 for removing the residual toner on the surface of the photoconductive body 3, a support member 62 which urges the cleaning blade 61 against the photoconductive body 3, a bias roller 64 for controlling the amount of charge of the residual toner, a recovery roller 66 for recovering the toner adhered on the cleaning blade 61, a flicker 63*a* for removing the residual toner adhered on the bias roller 64, and a flicker 63*b* for removing the residual toner adhered on the recovery roller 66. The residual toner cleaned by the cleaning blade 61 and the residual toner removed by the flickers 63*a* and 63*b* fall downwards due to its own weight, and is transported outside the process cartridge 1 by a transport auger 65 which is formed coaxially to the rotary axis or the engaging part 2*c* of the process cartridge frame body 2, to be recovered within a waste toner accommodating part (not shown).

The coating mechanism 6*b* includes a lubricant body 67, and a coating roller 66 which contacts the lubricant body 67 and wipes the lubricant from the lubricant body 67 to supply the lubricant on the surface of the photoconductive body 3. In this embodiment, the recovery roller 66 also functions as the coating roller 66, and thus, the roller 66 will hereinafter be referred to as a recovery and coating roller 66. A pressing spring (not shown) may be provided to push the lubricant body 67 against the recovery and coating roller 66 with a predetermined pushing force or pressure. In this case, the lubricant body 67 may have a rectangular parallelepiped shape and held in the cleaning module 6 with the lubricant body 67 contacting the recovery and coating roller 66 with the predetermined pressure applied from the pressing spring. Thus, the recovery and coating roller 66 simultaneously recovers the residual toner adhered on the cleaning blade 61 and coats the lubricant on the surface of the photoconductive body 3.

Although FIG. 20 shows the coating mechanism 6*b* included in the cleaning module 6, the coating mechanism 6*b* may be formed as a replaceable module that is separate from the cleaning mechanism 6*a*. In this case, the module of the coating mechanism 6*b* can be replaced independently of the cleaning mechanism 6*a*.

The recovery and coating roller 66 has a shape extending along the axial direction of the photoconductive body 3. The pressing spring constantly pushes the lubricant body 67 against the recovery and coating roller 66, so that it is possible to use substantially all of the lubricant body 67 for the lubricant coating. Because the lubricant body 67 is consumed, the thickness of the lubricant body 67 decreases with time or use. However, the lubricant can be wiped to be supplied and coated on the photoconductive body 3 in a stable manner, by constantly pushing the lubricant body 67 against the recovery and coating roller 66 by the action of the pressing spring.

The lubricant forming the lubricant body 67 may be fatty metal oxide salts, such as lead oleic acid, zinc oleic acid, copper oleic acid, zinc stearate, cobalt stearate, iron stearate, copper stearate, zinc palmitic acid, copper palmitic acid and zinc linolenic acid. The lubricant may also be fluorine-based resins such as polytetrafluoroethylene, polychlorotrifluoroethylene, polyfluoridevinylidene, polytrifluorochlorethylene, dichlorodifluoroethylene, tetrafluoroethylene-ethylne copolymer and tetrafluoroethylene-oxafluoropolypyrene copolymer. From the point of view of the large effect of reducing the friction of the photoconductive body 3, the lubricant is preferably metal oxide salt stearate, and more preferably zinc stearate.

Figure 21:
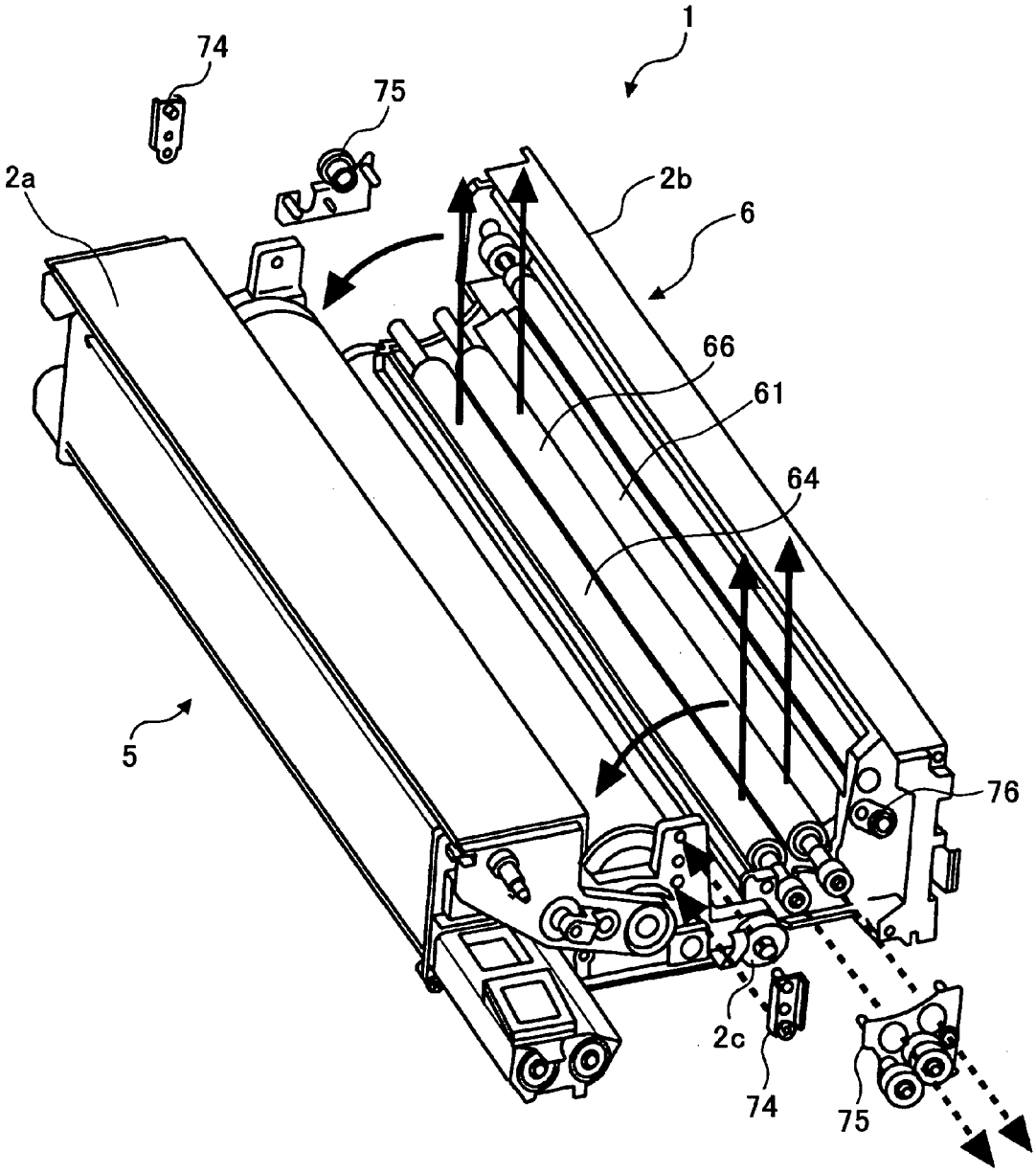
FIG. 21 is a perspective view of a cleaning module loaded in a second frame body.

FIG. 21 shows a cleaning module 6. In the embodiment, the cleaning module 6 includes a cleaning module 6*c* having a coating roller 66 and the others, and a cleaning module 6*d* having a cleaning blade 61 and the others. Further, each cleaning module 6*c* and 6*d* are exchangeable via an opened space formed after the second frame bodies 2*b* rotates to the open position. It is possible to separate modules so that parts of each module have the same replacement intervals. Therefore, a cleaning blade 61, a support member 62 having long replacement intervals can use so that wasteful parts are less.

Figure 22:
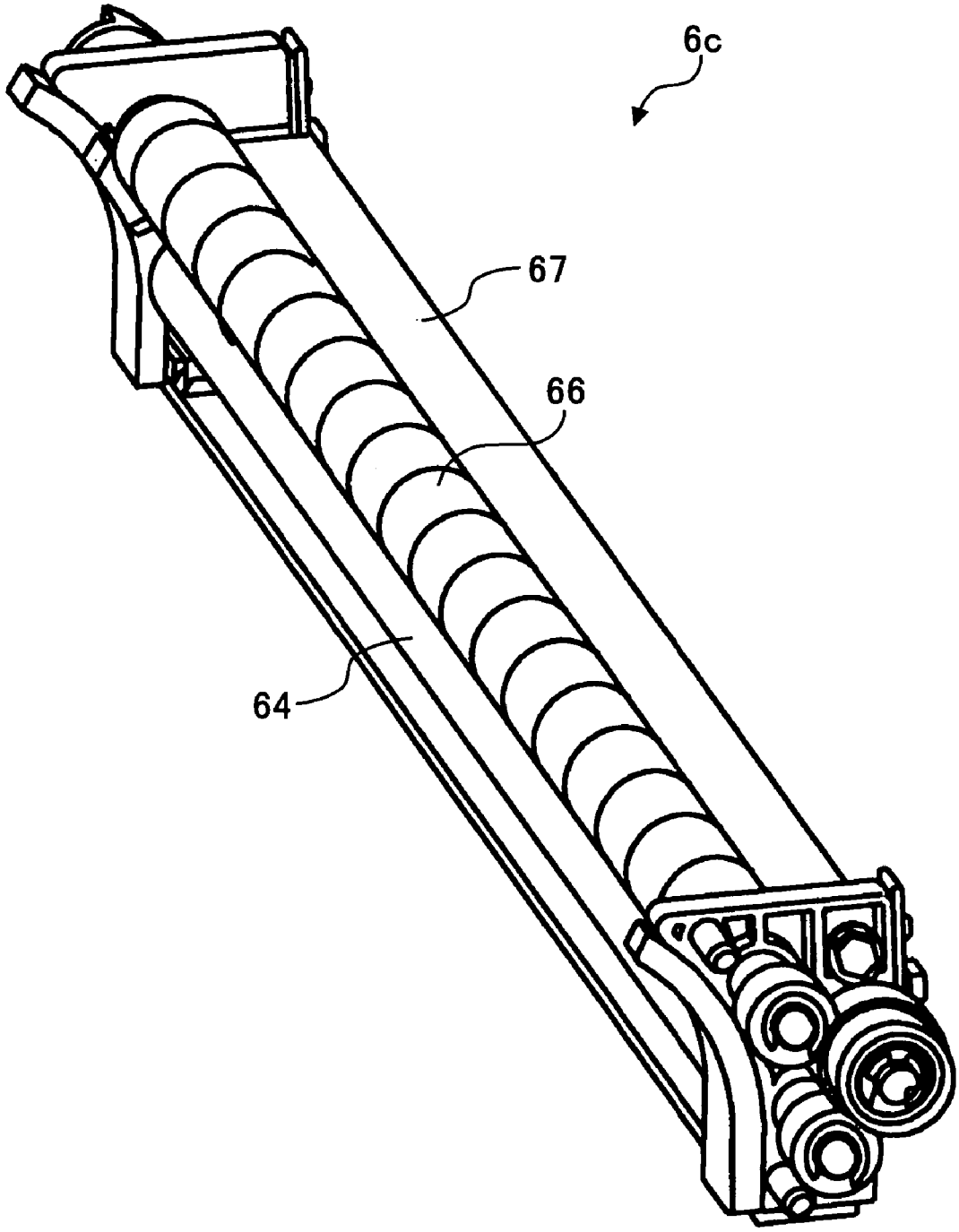
FIG. 22 is a perspective view showing of a cleaning module within the cleaning module.

FIG. 22 is a perspective view of the cleaning module 6*c* within the cleaning module. The cleaning module 6*c* includes the bias roller 64, the recovery and coating roller 66 and the like which rotate and can wear out. The bias roller 64, the recovery and coating roller 66 and the like may be replaced simultaneously in units of this module 6*c*. Parts having relatively short replacement intervals, such as the flicker 63*a* for removing the residual toner adhered on the bias roller 64 and the flicker 63*b* for removing the residual toner adhered on the recovery (and coating) roller 66, may also be included in the cleaning module 6*c* in addition to the bias roller 64 for controlling the amount of charge of the residual toner and the recovery and coating roller 66 for coating and recovering the lubricant. On the other hand, the cleaning blade 64, the support member 62 and the like may be replaced simultaneously in units of the cleaning module 6*d*. The parts included in the cleaning module 6*d* can have longer replacement intervals than the parts included in the cleaning module 6*c*, and may be relatively expensive compared to the parts included in the cleaning module 6*c*.

Figure 23:
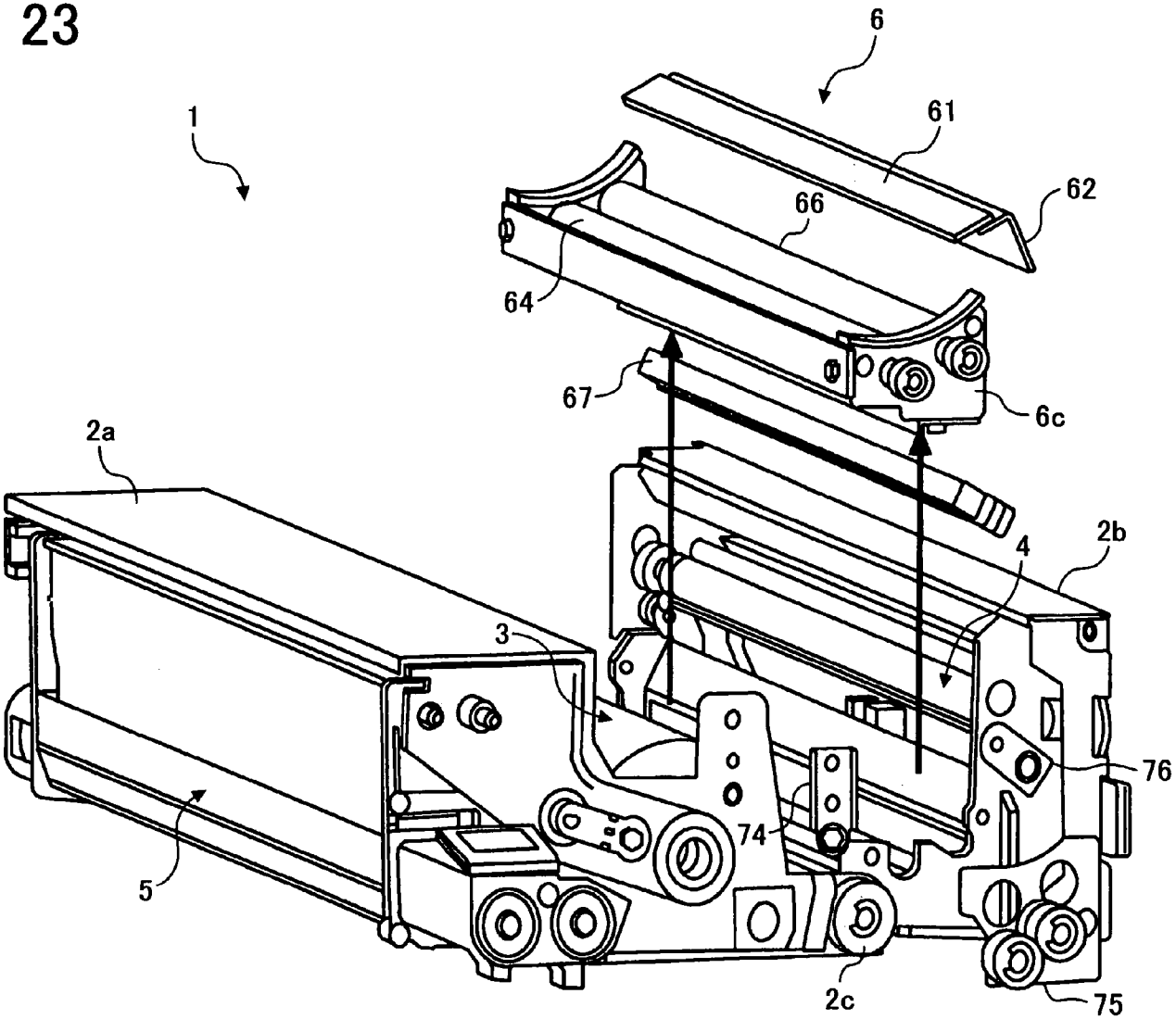
FIG. 23 is a perspective view generally showing the second frame body turned to form an open space and the cleaning modules removed from the open space.

FIG. 23 is a perspective view showing the second frame body 2*b* turned to form an open space and the cleaning modules removed via the open space. The second frame body 2*b* is turned relative to the first frame body 2*a* to form an open space, and the cleaning modules 6*c* and 6*d* are removed via this open space. The cleaning module 6*c* is fixed on the second frame body 2*b* by cleaning position determining members 75 each having 2 pins, and the bias roller 64 and the recovery and coating roller 66 are positioned to suitable contacting states on the photoconductive body 3. The cleaning module 6*d* is fixed on the second frame body 2*b* by blade positioning member 76, so that the cleaning blade 61 is positioned to a suitable contacting state on the photoconductive body 3. In this case, the lubricant body 67 is inserted into a hole formed in the second frame body 2*b*, and the lubricant body 67 is replaced after removing the cleaning module 6*c*.

The cleaning module 6*c* and/or the cleaning module 6*d* is replaced when the second frame body 2*b* is turned approximately 90 degrees with respect to the first frame body 2*a* and opened. By turning the second frame body 2*b*, the cleaning modules 6*c* and 6*d* can be replaced with the residual toner removed from the photoconductive body 3 is held within the second frame body 2*b*, and the scattering of the residual toner is effectively suppressed.

In the embodiment, as shown in FIG. 30, when the first and second frame bodies 2*a* and 2*b* are positioned at a closed position, a blade positioning member 76 may not be replaced because the first frame body 2*a* overlaps on the blade positioning member 76. Also, a cleaning position determining members 75 may not be replaced because the first frame body 2*a* overlaps a part of the cleaning position determining members 75. When the first and second frame bodies 2*a* and 2*b* are positioned at a open position, both of the cleaning position determining members 75 and the blade positioning member 76 can be easily replaced. Therefore, each of a cleaning position determining members 75 and a blade positioning member 76 is not erroneously removed.

In the process cartridge 1, each of the photoconductive body 3, the charging module 4, the developing module 5 and the cleaning module 6 (or the cleaning modules 6*c* and 6*d*) can be removed and replaced independently. Further, each of the replaced photoconductive body 3, charging module 4, developing module 5 and cleaning module 6 (or cleaning modules 6*c* and 6*d*) can accurately be positioned with respect to the process cartridge 1.

In addition, the positioning member 71 and the angular positioning member 72 for positioning the developing module 5, and the frame body positioning member 74 for positioning the photoconductive body 3 do not overlap on the process cartridge frame body 2. For this reason, the positioning members 71 and 72 can be replaced independently of the positioning member 74, such that the developing module 5 and the photoconductive body 3 can be replaced independently of each other.

Moreover, when the frame body positioning member 74 is removed and the second frame body 2*b* is turned approximately 90 degrees relative to the first frame body 2*a*, the positioning member 71 and the angular positioning member 72 for positioning the developing module 5, and the cleaning position determining member 75 and the blade positioning member 76 for positioning the cleaning modules 6*c* and 6*d* do not overlap on the process cartridge frame body 2. For this reason, the positioning members 71 and 72 can be replaced independently of the position determining members 75 and 76, such that the developing module 5 and the cleaning modules 6*c* and 6*d* can be replaced independently of each other.

Each of the positioning member 71 and the angular positioning member 72 for positioning the developing module 5, the fitting parts 15*f* and 15*r* for positioning the charging module 4 on the process cartridge frame body 2, and the cleaning position determining member 75 and the blade positioning member 76 for positioning the cleaning modules 6*c* and 6*d*, does not overlap with another positioning or position determining member associated with another module. For this reason, the positioning or position determining member and its associated module can be removed and loaded (that is, replaced) independently of other positioning or position determining member and its associated module.

Restated, the charging module 4 can be removed by pulling the charging module 4 upwards from the fitting part 15 of the process cartridge 1. The developing module 5 can be removed from the process module frame body 2 by removing the angular positioning member 72 and further the positioning member 71, as shown in FIGS. 17 and 18. In the case where the cleaning module 6 includes the cleaning modules 6*c* and 6*d* and when the frame body positioning member 74 is removed and the second frame body 2*b* is turned and opened, the cleaning module 6*c* can be removed by removing the cleaning position determining member 75, and the cleaning module 6*d* can be removed by removing the blade positioning member 76.

Figure 24:
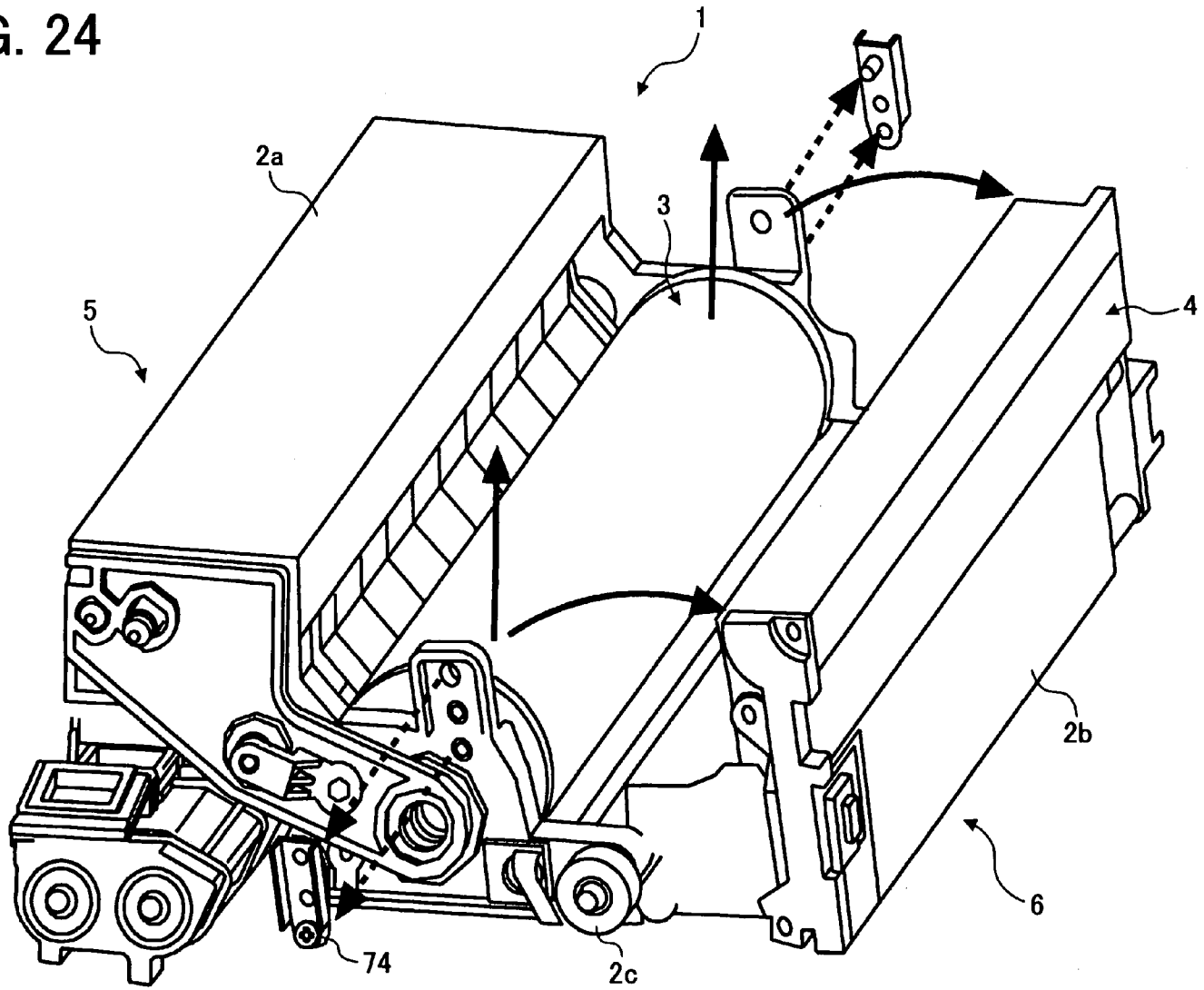
FIGS. 24 and 25 are perspective views showing the photoconductive body being removed and separated from the process cartridge.
Figure 25:
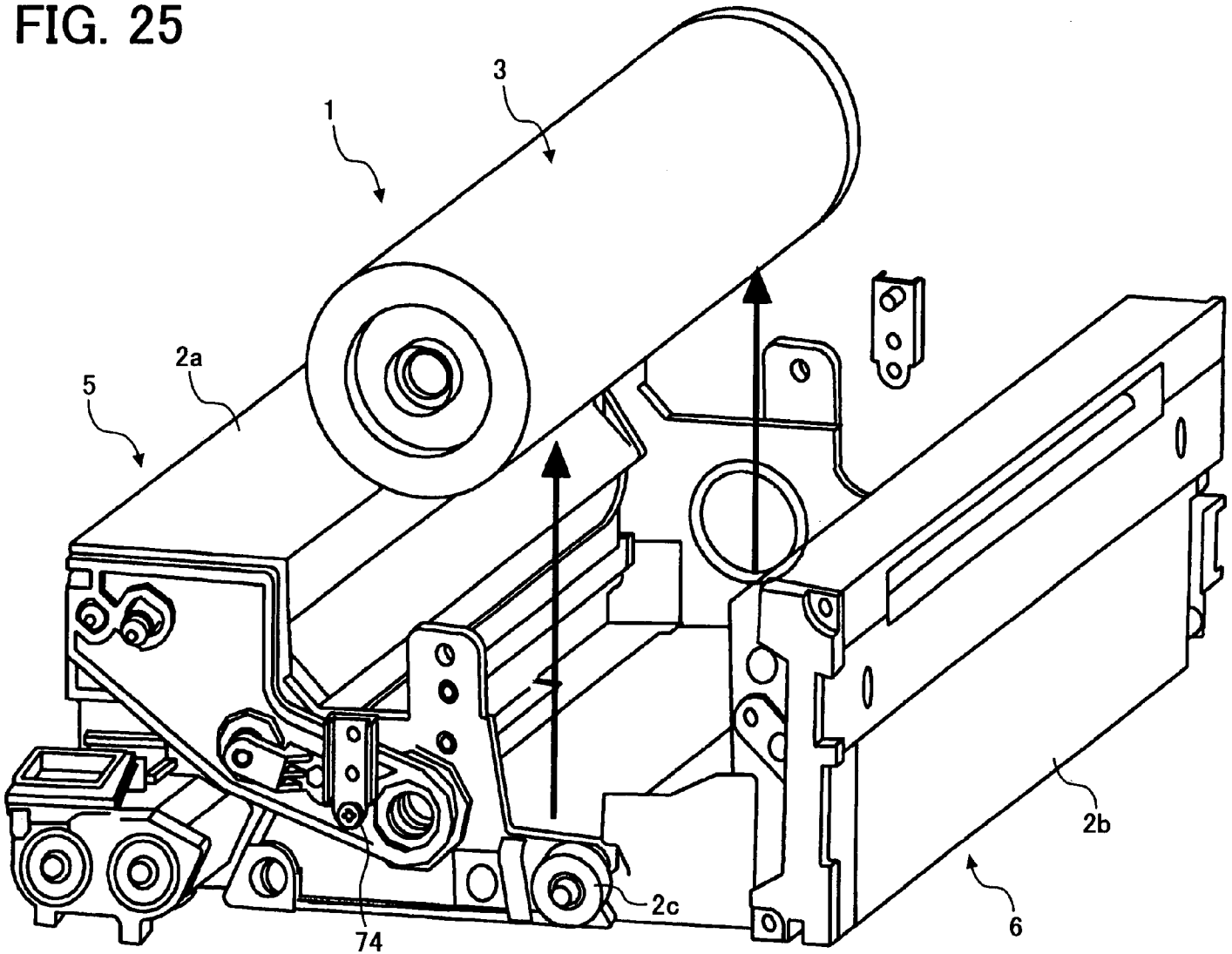

FIGS. 24 and 25 are perspective views showing the photoconductive body 3 being removed and separated from the process cartridge. That is, the positioning member 74 fixing the second frame body 2*b* is removed, and the second frame body 2*b* is turned about the engaging part 2*c* to form an open space above the process cartridge 1, as shown in FIG. 24. In this state, the photoconductive body 3 is merely supported by the support part 13 of the process cartridge frame body 2 and is not fixed to the process cartridge 1. The photoconductive body 3 can easily be removed by pulling the photoconductive body 3 upwards as shown in FIG. 25 while pushing the photoconductive body 3 against the frame body positioning member 74.

Figure 26:
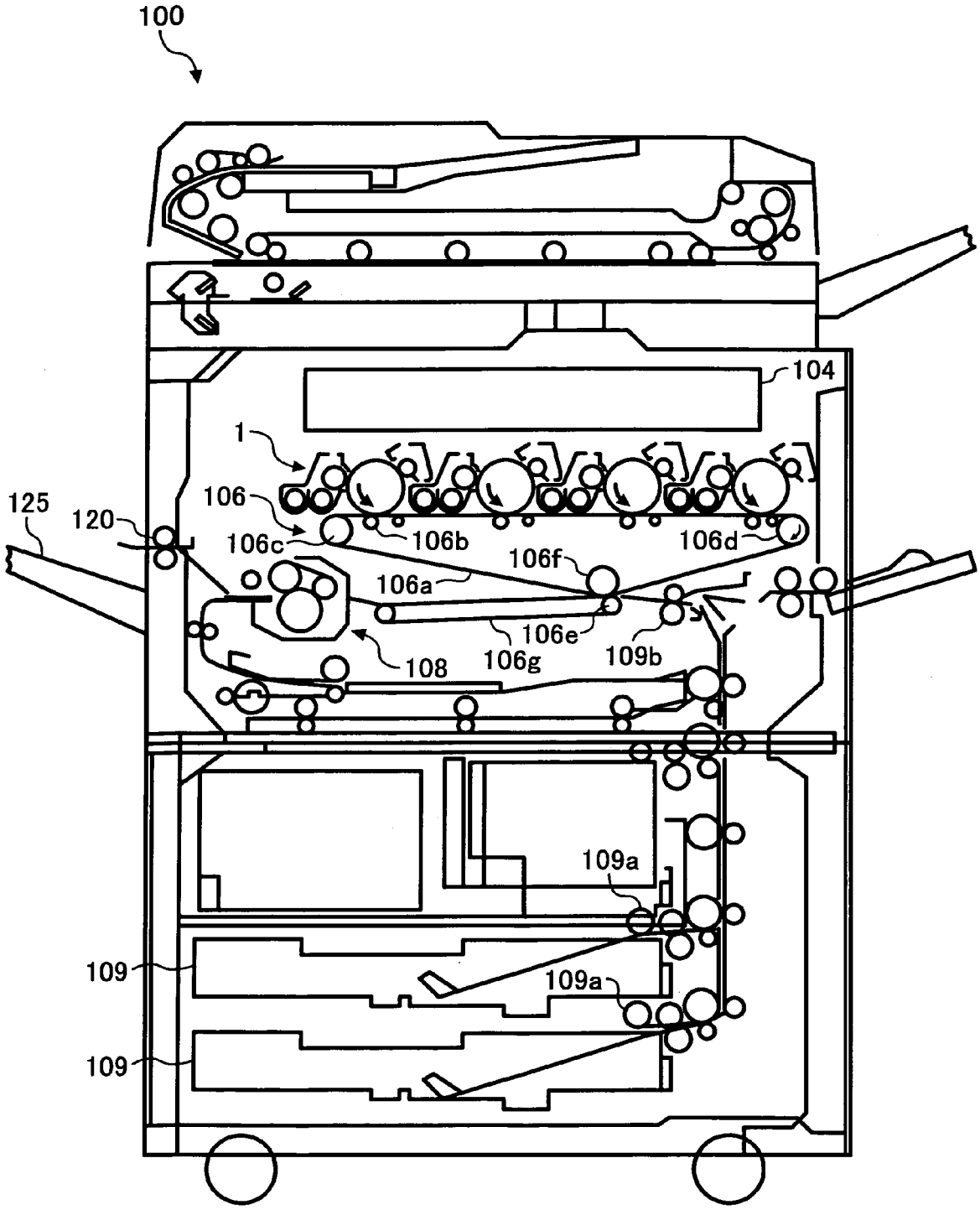
FIG. 26 is a diagram of an image forming apparatus.

FIG. 26 is a diagram of an image forming apparatus. In this embodiment, the present invention is applied to the image forming apparatus 100 which uses the electrophotography technique to form a full color image. The image forming apparatus 100 is a tandem type having 4 process cartridges 1 disposed in a transport direction of a recording medium such as paper. An endless intermediate transfer belt 106*a* of a transfer unit 106 is provided around 3 support rollers 106*c*, 106*d* and 106*f*. Yellow, cyan, magenta and black toner images are formed by the 4 process cartridges 1 and transferred onto the intermediate transfer belt 106*a* in an overlapping manner by electrostatic transfer provided by transfer rollers 106*b* confronting the photoconductive bodies 3 of the 4 process cartridges 1 via the intermediate transfer belt 106*a*. The transfer region is formed by each photoconductive body 3 and the corresponding portion of the intermediate transfer belt 106*a* pressed by the transfer roller 106*b*. The recording medium is transported by a transport belt 106*g*, and a positive polarity bias is applied to a transfer roller 106*e* when transferring the toner images on the intermediate transfer belt 106*a* onto the recording medium transported on the transport belt 106*g*. As a result, the toner image formed by the photoconductive body 3 of each process cartridge 1 is successively and electrostatically transferred from the intermediate transfer belt 106*a* onto the recording medium, and fixed by a fixing unit 108. A belt cleaning unit may be provided in a periphery of the intermediate transfer belt 106*a* to remove the residual toner on the surface of the intermediate transfer belt 106*a*. An exposure unit 104 forms a latent image on the photoconductive body 3, as described below.

Medium supply cassettes 109 accommodate the recording media, and each recording medium is fed by a resist roller pair 109*a* and transported by the transport belt 106*g*. In this embodiment, the overlapping toner images formed on the recording medium is fixed by heat and pressure applied by the fixing unit 108, and is ejected outside the image forming apparatus 100 onto an eject tray 125 via eject rollers 120.

In the embodiment, a process cartridge 1 can be supplied with new toner. The process cartridge 1 is initially sold with a supply opening 59 covered by a seal, a cap or the like, which is removed at a first use of the process cartridge 1. In general, a spent process cartridge is disposed of without refilling. However, a process cartridge 1 in the embodiment can be reused if new toner supplied. Also, the process cartridge 1 can stock a new toner in a developing agent accommodating part 53. It is applicable that such toner is supplied into the process cartridge 1 after a toner in the process cartridge 1 is used up, or is a reused toner after recycled. Also, it is applicable that an image forming apparatus 100 includes a toner accommodating portion (not shown) to supply new toner to the process cartridge 1. In such case, because a developing module 5 can be supplied new toner, the developing module 5 may be used repeatedly.

In the image forming apparatus 100, it is preferable to use a toner having an average circularity of 0.93 or greater. When the toner manufactured by dry grinding, the circularity can be adjusted by a thermal or mechanical process which shapes the toner particles (or grains) into approximately spherical shapes. When carrying out the thermal process to shape the toner particles, the toner particles may be sprayed to an atomizer or the like together with hot air. On the other hand, when carrying out the mechanical process to shape the toner particles, the toner particles may be supplied to a mixer, such as a ball mill, together with a mixture medium having a low specific gravity such as glass and agitated. A classification process may be carried out because large toner particles are generated by the thermal process and fine toner particles are generated by the mechanical process. When the toner is manufactured within an aqueous solution, the shape of the toner particles can be controlled by strongly agitating the toner particles during the process of removing the solution.

A circularity SR may be defined as SR=[(periphery of circle having the same area as a particle projection area)/(periphery of particle projection image)×100]%, and the toner particle becomes approach a true spherical shape as the circularity SR approaches 00%, where the periphery of indicates the peripheral length. The toner particles having a high circularity SR are easily affected by the electric line of force on the carrier or the developing sleeve 51, and are accurately developed along the electric line of force of the electrostatic latent image. When reproducing fine latent image dots, it is easier to obtain a precise and uniform toner arrangement, thereby making it possible to obtain a high reproducibility of thin lines. In addition, because the toner particles having the high circularity SR have a smooth surface and suitable fluidity (or flowability), these toner particles are easily affected by the electric line of force and accurately move along the electric line of force, and a transfer efficiency (or transferring rate) becomes high to enable a high-quality image to be formed. Even when the intermediate transfer belt 106*a* pushes against the photoconductive body 3, the toner particles having the high circularity SR uniformly contact the intermediate transfer belt 106*a*, and a uniform contact area contributes to the improvement of the transfer efficiency. However, when the average circularity of the toner particles is less than 0.93, accurate development and transfer with a high transfer efficiency may not be achieved. This is because the charge on the toner surface is non-uniform when the toner particles have undefined shapes, and it is difficult for the toner particles to move accurately with respect to the electric field due to the center of gravity and the center of the charging differing from one another.

Next, a description of the image forming operation of the image processing apparatus 100, for one process cartridge 1, is provided. When the image forming operation starts, the charging module 4 uniformly charges the photoconductive body 3 to a negative polarity. The exposure unit 104 scans the surface of the photoconductive body 3 by a laser beam based on image data related to the image that is to be formed, to form a latent image on the photoconductive body 3. The developing module 5 visualizes the latent image into a toner image. In this state, the photoconductive body 3 bearing the toner image rotates and enters the transfer region, and with respect to the intermediate transfer belt 106 which moves in synchronism with the rotation of the photoconductive body 3, the bias applied from the transfer roller 106*b* causes the toner image to be transferred onto the intermediate transfer belt 106 in the transfer region. In the transfer region, the developed toner image on the photoconductive body 3 is affected by the transfer electric field and the nip pressure.

In the case of the tandem type image forming apparatus 100 which uses the 4 process cartridges 1 accommodating toners of mutually different colors, the toner images of different colors are formed on the photoconductive bodies 3 of the 4 process cartridges 1 and successively transferred onto the intermediate transfer belt 106*a* in an overlapping manner, to form a full-color toner image. When the recording medium from the medium supply cassette 109 is fed by the resist roller pair 109*a* towards the supply roller 106*f*, the recording medium reaches a secondary transfer region in synchronism with the movement of the intermediate transfer belt 106*a*. In the secondary transfer region, the bias applied from the transfer roller 106*e* causes the full-color toner image to be transferred from the intermediate transfer belt 106*a* onto the recording medium. The full-color toner image on the recording medium is melted and fixed by the fixing unit 108, and is ejected onto the eject tray 125 by the eject rollers 120.

After the image is formed on the photoconductive body 3, the recovery and coating roller 66 of the coating mechanism 6*b* wipes the zinc stearate lubricant from the lubricant body 67, and coats this lubricant on the surface of the photoconductive body 3 by making sliding contact with the photoconductive body 3. Then, the cleaning blade 61 in contact with the photoconductive body 3 presses the lubricant to form a thin lubricant layer on the surface of the photoconductive body 3. By forming the thin lubricant layer, the residual toner on the photoconductive body 3 becomes more easily cleanable (or removable), and the residual toner can be removed even when the toner particles have a high circularity.

The thin lubricant layer formed on the surface of the photoconductive body 3 by the cleaning blade 61 of the cleaning module 6 reduces a coefficient of friction of the surface of the photoconductive body 6. The coefficient of friction, μ, of the surface of the photoconductive body 3 is preferably set to 0.4 or less. The coefficient of friction, μ, of the surface of the photoconductive body 3 may be controlling the setting conditions of the coating mechanism 6*b*, such as a pressure applied to the lubricant body 67 by the pressing spring, and the brush density, the brush diameter, the rotational speed and the rotating direction of the recovery and coating roller 66.

By setting the coefficient of friction, μ, of the surface of the photoconductive body 3 to 0.4 or less, it is possible to suppress the friction between the cleaning blade 61 and the photoconductive body 3 from becoming large, suppress deformation or turning of the cleaning blade 61, prevent the toner from slipping past the cleaning blade 61, and suppress the generation of poor cleaning. Furthermore, the above coefficient of friction, μ, is more preferably 0.3 or less. The coefficient of friction, μ, of the surface of the photoconductive body 3 is affected by other parts, modules or units provided within the image forming apparatus 100, and the value of the coefficient of friction, A, changes from the value immediately after the image formation. However, for the image formation with respect to approximately 1,000 recording media, namely, A4-size recording paper, the value of the coefficient of friction, μ, remains substantially constant. Accordingly, the coefficient of friction, μ, in this embodiment refers to the coefficient of friction that becomes substantially constant in the steady state.

Because the thin line reproducibility is improved when a volume average particle size (diameter) Dv of the toner is reduced, the volume average particle size Dv of the toner used in this embodiment is 8 μm or less. But on the other hand, the developing characteristic and the cleaning characteristic deteriorate when the volume average particle size Dv is small, and it is preferable that the volume average particle size Dv is 3 μm or greater to prevent the developing and cleaning characteristic deterioration. When the volume average particle size Dv is less than 3 μm, the amount of fine toner particles which are uneasily developed tend to increase on the carrier or the surface of the developing sleeve 51, thereby causing the contact or friction of the other toner particles with the carrier or the developing sleeve 51 insufficient and the reverse charged toner particles to increase, to generate an abnormal image, such as fogging.

A particle size distribution described by a ratio (Dv/Dn) of the volume average particle size Dv and a number average particle size Dn is preferably from 1.05 to 1.40. By narrowing the particle size distribution, the charging distribution of the toner becomes uniform. When the ratio (Dv/Dn) exceeds 1.40, the charging distribution of the toner becomes wide and the reverse charged toner particles increase, thereby making it difficult to obtain a high-quality image. The toner having the ratio (Dv/Dn) that is less than 1.05 is not practical because it is difficult to manufacture such toner. The toner size can be measured by use of a Koltar counter multisizer (manufactured by Koltar), by selectively using 50 μm apertures for the measuring holes to cooperate with the toner size to the measured, and taking an average of 50,000 toner particles.

Figure 27A:
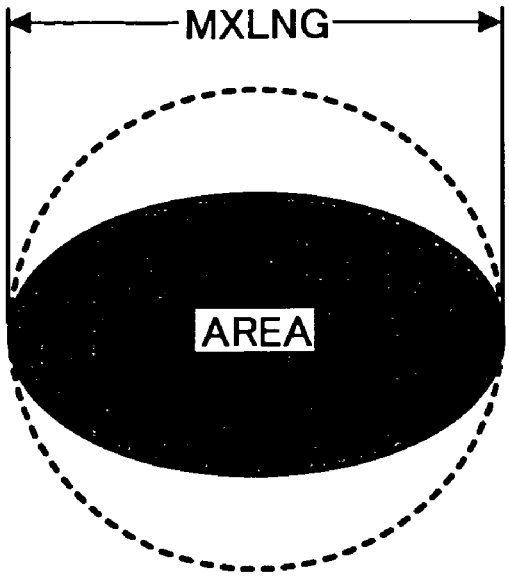
FIGS. 27A and 27B are diagrams showing toner shapes factor SF-1 and a shape factor SF-2.
Figure 27B:
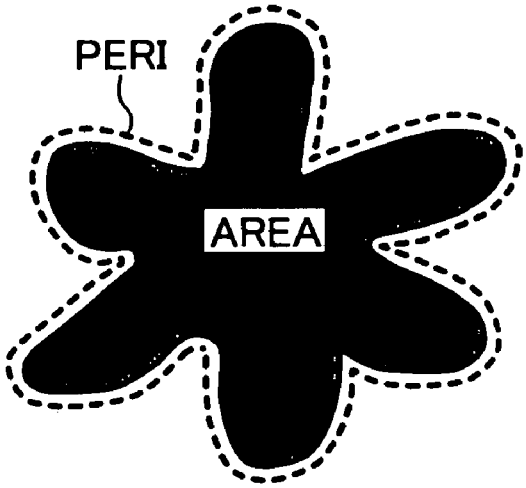

Of the circularity, it is preferable that the toner has a shape factor SF-1 in a range greater than or equal to 100 and less than or equal to 180 and a shape factor SF-2 in a range greater than or equal to 100 and less than or equal to 180. FIGS. 27A and 27B are diagrams showing toner shape factors SF-1 and SF-2. The shape factor SF-1 indicates a proportion of circularity of the toner particle and is represented by the following formula (1). A square of a maximum length MXLNG of the shape obtained by projecting the toner particle in a two-dimensional plane, is divided by a graphic area AREA and is then multiplied by 100π/4 to obtain the value of the shape factor SF-1.

$$SF\text{-}1=\{(MXLNG)^2/\mathrm{AREA}\}\times(100\pi/4) \quad (1)$$

When the value of SF-1 is equal to 100, the shape of the toner particle is perfectly circular, and as the value of SF-1 increases, the shape becomes more indefinite.

The shape factor SF-2 indicates a proportion of surface unevenness of the toner particle and is represented by the following formula (2). A square of a periphery PERI of the shape obtained by projecting the toner particle in a two-dimensional plane is divided by a graphic area AREA and is then multiplied by 100π/4 to obtain the value of the shape factor SF-2.

$$SF\text{-}2=\{(PERI)^2/\mathrm{AREA}\}\times(100\pi/4) \quad (2)$$

When the value of SF-2 is equal to 100, there is no unevenness on the surface of the toner particle, and as the value of SF-2 decreases, the surface unevenness of the toner particle becomes more conspicuous.

The shape factor was measured by taking a picture of the toner particle with a scanning electron microscope (S-800 manufactured by HITACHI SEISAKUSHO), analyzing it with an image analyzer (LUSEX3 manufactured by NIRECO CO., LTD.), and calculating the shape factor.

The toner particles preferably have the shape factor SF-1 from 100 to 180 and the shape factor SF-2 from 100 to 180. When the shape of the toner particles is closer to the circular shape, the contact of the toner particle with other toner particle or the contact of the toner particle with the photoconductive body 3 is a point contact, which improves the fluidity of the toner. Thus, the mutual adhesion of toner particles weakens and the fluidity is improved, thereby improving the transfer efficiency and facilitating the cleaning of the residual toner on the photoconductive body 3.

Therefore, the shape factors SF-1 and SF-2 are preferably 100 or greater. Furthermore, as the shape factors SF-1 and SF-2 increase, the toner particle shape becomes indefinite, the charging distribution of the toner widens, the development is no longer accurate with respect to the latent image, and the transfer is no longer accurate with respect to the transfer electric field, thereby deteriorating the image quality. In addition, the transfer efficiency deteriorates and the residual toner after the transfer increases, thereby requiring a large cleaning module 6, which is undesirable from the point of view of designing the image forming apparatus 100. For this reason, the shape factors SF-1 and SF-2 preferably do not exceed 180.

Figure 28A:
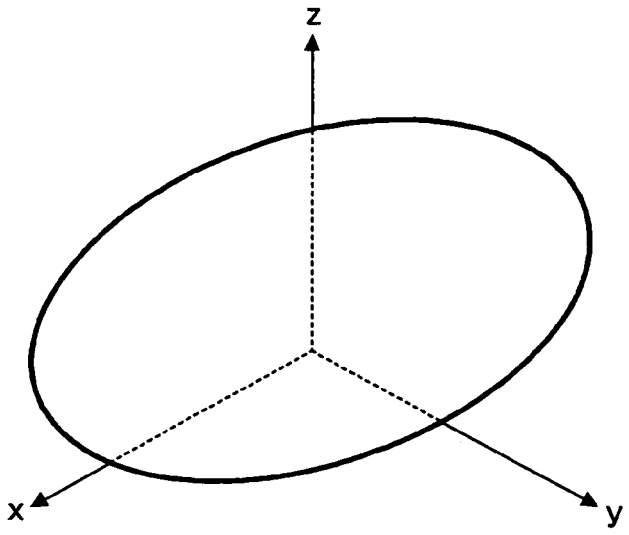
FIG. 28A is a perspective view of a general shape of the toner.
Figure 28B:
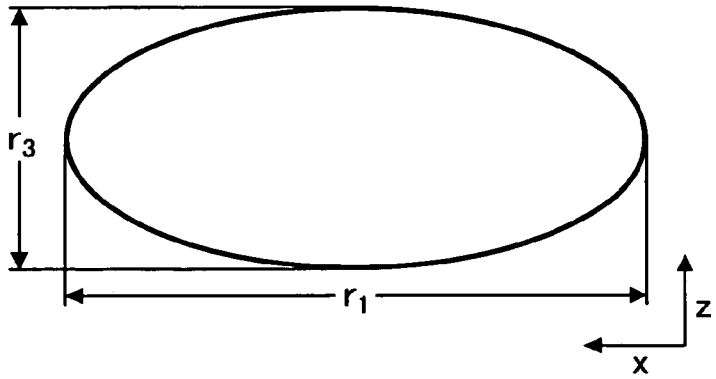
FIGS. 28B and 28C are cross sectional views of the toner along x-z and y-z planes.
Figure 28C:
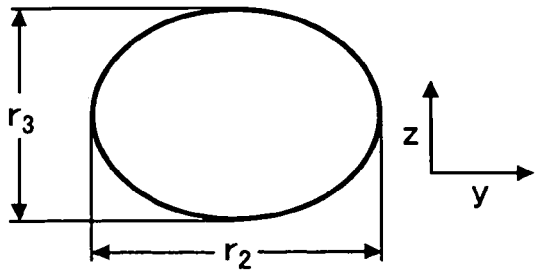

The toner particles may be spherical in shape and can be expressed in terms of the following shape regulation. FIG. 28A is a perspective view of the toner, and FIGS. 29B and 29C are cross sectional views of the toner along x-z and y-z planes. When the roughly spherical toner particles are regulated by a major axis r1, a minor axis r2 and a thickness r3 (provided that r1≧r2≧r3), a ratio r2/r1 of the major axis r1 and the minor axis r2 (see FIG. 29B) is preferably from 0.5 to 1.0 and a ratio r3/r2 of the thickness r3 and the minor axis r2 (see FIG. 29C) is preferably from 0.7 to 1.0. If the ratio r2/r1 is less than 0.5, the charging distribution widens because the toner particle shape becomes more indefinite. Moreover, if the ratio r3/r2 is less than 0.7, the charging distribution of the toner particles widens because the −10 toner particle shape becomes more indefinite. Particularly, if the ratio r3/r2 is 1.0, the charging distribution of the toner particles becomes narrow because the toner particle shape becomes approximately spherical. The toner particle size was measured by a scanning electron microscope (SEM) by taking pictures by changing an angle of field of vision and while observing.

The toner particle shape can be controlled by the manufacturing method. For example, when the toner that is manufactured by dry grinding, the surface of the toner particles is uneven and the toner particle shape is indefinite. By even such a toner manufactured by the dry grinding can be formed can be adjusted by a thermal or mechanical process which shapes the toner particles into approximately spherical shapes which are close to true spherical shapes. The toner particles manufactured by forming droplets by suspension polymerization method or emulsion polymerization method have a smooth surface and an approximately spherical shape close to a true spherical shape. In addition, the toner particles can be made rugby ball shaped by applying a shearing force by strongly agitating the toner particles during a reaction process within a solvent.

The approximately (or roughly) spherical toner particles are preferably made by subjecting a toner material solution to a cross linking reaction and/or an extension reaction within an aqueous medium, where the toner material solution is obtained by dissolving or dispersing, within an organic solvent, at least a polyester prepolymer having a functional group that includes nitrogen atoms, a polyester, a colorant and a mold releasing agent.

A description of the constituent elements of the toner and the preferable manufacturing method of the toner is now provided. The toner in this embodiment contains modified polyester (i) as a binder resin. Modified polyester includes a polyester in which there is a bonding group present other than an esterbond in the polyester resin and resinous principles having a different structure in the polyester resin are bonded by a bond like covalent bond and ion bond. More particularly, it includes a polyester terminal that is modified by introducing a functional group like an isocyanate group that reacts with a carboxylic acid group, a hydroxyl group to a polyester terminal and then permitted to react with a compound containing active hydrogen.

An examples of the modified polyester (i) is an urea modified polyester that is obtained by allowing to react a polyester prepolymer (A) having an isocyanate group with an amine (B). Examples of the polyester prepolymer (A) having the isocyanate group are condensates of polyhydric alcohols (PO) and polyhydric carboxylic acids (PC) and furthermore polyester prepolymers obtained by allowing to react a polyester having an active hydrogen group with a polyhydric isocyanate compound (PIC). Examples of the active hydrogen groups are hydroxyl groups (alcoholic hydroxyl group and phenolic hydroxyl group), amino group, carboxyl group, mercapto group, among which the alcoholic hydroxyl group is desirable.

The urea modified polymer is prepared as follows. Examples of the polyhydric alcohol compounds (PO) are dihydric alcohols (DIO) and polyhydric alcohols not below trihydric alcohol (TO). Solely the dihydric alcohol (DIO) or a mixture of a small quantity of trihydric alcohol (TO) with a dihydric alcohol (DI) is desirable. Examples of the dihydric alcohol (DIO) are, alkylene glycols (e.g. ethylene glycol, 1,2-propylene glycol, 1,3-propylene glycol, 1,4-butanediol, and 1,6-hexanediol), alkylene ether glycols (e.g. diethylene glycol, triethylene glycol, dipropylene glycol, polyethylene glycol, polypropylene glycol, and polytetramethylene ether glycol), alicyclic diols (e.g. 1,4-cyclohexane dimethanol, and hydrogen additive bisphenol A), bisphenols (e.g. biphenol A, biphenol F, and bisphenol S), adducts of alkylene oxides of these alicyclic diols (e.g. ethylene oxides, propylene oxides, and butylenes oxides), and adducts of alkylene oxides of the phenols (e.g. ethylene oxides, propylene oxides, and butylenes oxides). Adducts of alkylene oxides of the bisphenols and alkylene glycols having a carbon number from 2 to 12 are desirable. The adducts of alkylene oxides of bisphenols and the adducts of alkylene oxides of bisphenols together with the alkylene glycols having a carbon number from 2 to 12 are particularly desirable. Examples of the polyhydric alcohols not below trivalent alcohols (TO) are polyhydric aliphatic alcohols from trivalent to octavalent alcohols and above (e.g. glycerin, trimethylol ethane, trimethylol propane, pentaerythritol, and sorbitol), phenols not below trivalent phenols (e.g. trisphenol PA, phenol novolak, and cresol novolak), and adducts of alkylene oxides of polyphenols not below trivalent polyphenols.

Examples of the polyhydric carboxylic acid (PC) are dihydric carboxylic acid (DIC) and poly hydric carboxylic acids not below trivalent carboxylic acid (TC). The dihydric carboxylic acid (DIC) or a mixture of a small quantity of trihydric carboxylic acid (TC) with a dihydric carboxylic acid (DIC) is desirable. The examples of dihydric carboxylic acid are alkylene dicarboxylic acids (e.g. succinic acid, adipic acid, and sebacic acid), alkenylene dicarboxylic acids (e.g. maleic acid, and fumaric acid), and aromatic dicarboxylic acids (e.g. phthalic acid, isophthalic acid, terephthalic acid, and naphthaline dicarboxylic acid). Among these, the alkenylene dicarboxylic acids having a carbon number from 4 to 20 and the aromatic dicarboxylic acids having a carbon number from 8 to 20 are desirable. Examples of the polyhydric carboxylic acids not below the trivalent carboxylic acid are aromatic polyhydric carboxylic acids having a carbon number from 9 to 20 (e.g. trimellitic acid and pyromellitic acid). The acid anhydrides and low alkyl esters of these can be used as polyhydric carboxylic acids and may be permitted to react with the polyhydric alcohols (PO).

The ratio of the polyhydric alcohol (PO) and the polyhydric carboxylic acid (PC) is an equivalent ratio [OH] [COOH] of a hydroxyl group [OH] and a carboxyl group [COOH] and is generally from 2/1 to 1/1. The desirable ratio is from 1.5/1 to 1/1 and a range of 1.3/1 to 1.02/1 is particularly desirable.

The polycondensation reaction of the polyhydric alcohol (PO) and the polyhydric carboxylic acid (PC) is made in the presence of a known esterification catalyst such as tetrabutoxytitanate and dibutyl tin oxide, by heating to a temperature of 150° C. to 280° C., while carrying out vacuum distillation of water if desired, to obtain a polyester having a hydroxyl group. The hydroxyl value of the polyester is preferably 5 or greater, and the acid value of the polyester is generally from 1 to 30, and preferably from 5 to 20. By providing the polyester with such an acid value, the polyester can easily have negative electrification. In addition when fixing the toner image on the recording medium, the affinity of the toner and the recording medium improves, to thereby improve the fixing at the low temperature. But when the acid value exceeds 30, the electrification stability tends to deteriorate particularly with respect to an environmental change.

The weight average molecular weight of the polyester is from 10,000 to 400,000, and preferably from 20,000 to 200,000. The weight average molecular weight less than 10,000 is undesirable in that the offset resistance deteriorates. Further, weight average molecular weight exceeding 400,000 is undesirable in that the fixing at the low temperature deteriorates.

In addition to the non-modified polyester obtained by the polycondensation reaction described above, the polyester preferably includes urea-modified polyester. The urea-modified polyester may be obtained by allowing the carboxyl group, the hydroxyl group, etc. of the terminal functional group of the polyester that is obtained by the polycondensation reaction described above to react with the polyhydric isocyanate compound (PIC), to obtain the polyester prepolymer (A) having the isocyanate group, and allowing it to react with amines, resulting in the cross linking reaction and/or extension reaction of the molecular chain.

Examples of the polyhydric isocyanate compounds (PIC) are aliphatic polyhydric isocyanates (e.g. tetramethylene diisocyanate, hexamethylene diisocyanate, and 2,6-diisocyanate methyl caproate), alicyclic polyisocyanates (e.g. isophorone diisocyanate and cyclohexylmethane diisocyanate), aromatic diisocyanates (e.g. tolylene diisocyanate and diphenyl methane diisocyanate), aromatic aliphatic diisocyanates (e.g. α,α,α',α'-tetramethyl xylynene diisocyanate), isocyanates, compounds formed by blocking these polyisocyanates by a phenol derivative, an oxime, and caprolactum, and a combination of more than any one of these.

The ratio of the polyhydric isocyanate compound (PIC) is an equivalent ratio [NCO]/[OH] of an isocyanate group [NCO] and a hydroxyl group [OH] of a polyester and is generally from 5/1 to 1/1. The desirable ratio is from 4/1 to 1.2/1 and a range of 2.5/1 to 1.5/1 is particularly desirable. If the ratio [NCO]/[OH] is more than 5, the fixing of an image at a low temperature is affected. If the mole ratio of [NCO] is less than 1, when urea non-modified polyester is used, the urea content in the ester is lowered, thereby affecting the offset resistance.

The content of the polyhydric isocyanate compound (PIC) in the polyester prepolymer (A) having an isocyanate group, is generally from 0.5 weight percent to 40 weight percent. The desirable range of the content of the polyhydric isocyanate compound is 1 weight percent to 30 weight percent and a range of 2 weight percent to 20 weight percent is more desirable. If the content of the polyhydric isocyanate compound is less than 0.5 weight percent, the hot offset resistance is deteriorated and it is unfavorable from the point of view of compatibility of heat conserving resistance and fixing at the low temperature. On the other hand, if the content of the polyhydric isocyanate compound is more than 40 weight percent, there is a deterioration of fixing at the low temperature.

The content of the isocyanate group per molecule in the polyester prepolymer (A) having an isocyanate group is generally 1. The desirable range of the content of the isocyanate group is on average 1.5 to 3 and a range of 1.8 to 2.5 is more desirable. If the content of the isocyanate group per molecule is less than 1, then the molecular weight of the urea-modified polyester is lowered and the hot offset resistance is deteriorated.

Further, examples of amines (B) that are permitted to react with the polyester prepolymers (A) are hydric amine compounds (B1), polyhydric amine compounds (B2) not below trivalent amines, amino alcohols (B3), amino mercaptans (B4), amino acids (B5), and compounds (B6) in which the amino groups from B1 to B5 are blocked.

Examples of the dihydric amine compounds (B1) are aromatic diamines (e.g. phenylene diamine, diethylene diamine, and 4,4'-diamino diphenyl methane), acrylic diamines (e.g. 4,4'-diamino-3,3'-dimethyl dicyclohexyl methane, diamine cyclohexane, and isophorone diamine), and aliphatic diamines (e.g. ethylene diamine, tetramethylene diamine, and hexamethylene diamine). Examples of the polyhydric amine compounds (B2) not below trivalent amine are diethylene triamine and triethylene tetramine. Examples of the amino alcohols (B3) are ethanol amine and hydroxyethyl aniline. Examples of the amino mercaptans (B4) are amino ethyl mercaptan and amino propyl mercaptan. Examples of amino acids (B5) are amino propionic acid and amino caproic acid. Examples of the compounds (B6) in which the amino groups from B1 to B5 are blocked are ketimine compound and oxazolidine compounds obtained from the ketones and amines in B1 to B5 above (e.g. acetone, methyl ethyl ketone, and methyl isobutyl ketone). The desirable amines among the amines (B) are B1 and mixtures of B1 with a small amount of B2.

The ratio of amines is an equivalent ratio [NCO]/[NHx] of an isocyanate group [NCO] in the polyester prepolymers (A) having an isocyanate group and an amine group [NHx] in the amines (B) and is generally from 1/2 to 2/1. The desirable ratio is from 1.5/1 to 1/1.5 and a range of 1.2/1 to 1/1.2 is particularly desirable. If the ratio [NCO]/[NHx] is more than 2 or less than 1/2, the molecular weight of the urea-modified polyester decreases and the hot offset resistance is deteriorated.

Moreover, an urethane bond may be included together with an urea bond in the urea-modified polyester. The mole ratio of the urea bond content and the urethane bond content is generally from 100/0 to 10/90. The desirable ratio is from 80/20 to 20/80 and a range of 60/40 to 30/70 is more desirable. If the mole ratio of the urea bond is less than 10 percent, the hot offset resistance is deteriorated.

The urea-modified polyester (i) may be manufactured by a method including a one-shot method and a prepolymer method. The polyhydric alcohol (PO) and the polyhydric carboxylic acid (PC) are heated to a temperature from 150° C. to 280° C. in the presence of a known esterification catalyst such as tetrabutoxytitanate and dibutyl tin oxide, while carrying out vacuum distillation of water if desired, to obtain the polyester having the hydroxyl group. Then, the polyhydric isocyanate compound (PIC) is permitted to react at a temperature of 40° C. to 140° C., to obtain the polyester prepolymer (A) having the isocyanate group. Further, the amine (B) is permitted to react with the polyester prepolymer (A) at a temperature from 0° C. to 140° C., to obtain the urea-modified polyester.

When allowing the polyhydric isocyanate compound (PIC) to react with the polyester having the hydroxyl group, and when allowing the polyester prepolymer (A) to react with the amine (B), it is possible to use a solvent if desired. The usable solvent includes aromatic solvents (toluene, xylene etc.), ketones (acetone, methyl ethyl ketone, methyl isobutyl ketone, etc.), esters (acetic ester, etc.), amides (dimethyl formamide, dimethyl acetoamide, etc.), and ethers (tegrahydroduran, etc.), which are inert with respect to the polyhydric isocyanate compound (PIC).

A reaction inhibitor can be used if desired in the cross linking reaction and/or extension reaction between the polyester prepolymer (A) and the amine (B), to adjust the molecular weight of the urea-modified polyester that is obtained. Examples of the reaction inhibitors are monoamines (e.g. diethyl amine, dibutyl amine, butyl amine, lauryl amine, etc.) and the compounds in which these are blocked (e.g. ketimine compounds).

The weight average molecular weight of the modified polyester (i) is generally not less than 10,000. The desirable weight average molecular weight is from 20,000 to 10,000,000 and the weight average molecular weight from 30,000 to 1,000,000 is more desirable. Here, the desirable range of the peak molecular weight is 1,000 to 10,000. If it is less than 1,000, it becomes difficult to carry out the extension reaction due to which the elasticity of the toner is low, thereby deteriorating the hot offset resistance. If the peak molecular weight is more than 10,000, the fixing of the image is deteriorated and there are problems in manufacturing regarding small particle size and pulverization. The number average molecular weight of the modified polyester (i) is not restricted only in a case of using the non-modified polyester (ii) described below and may be a number average molecular weight that is suitable to obtain the weight average molecular weight. If the modified polyester (i) is used solely, the number average molecular weight is generally not more than 20,000 and is desirably from 1,000 to 10,000. A range of 2,000 to 8,000 is more desirable. If the number average molecular weight is more than 20,000, the fixing at the low temperature and the gloss when a full-color unit is used, are deteriorated.

A reaction inhibitor can be used if desired in cross linking reaction and/or extension reaction between the polyester prepolymer (A) and the amine (B) to obtain a modified polyester (i), to adjust the molecular weight of the urea-modified polyester that is obtained. Examples of the reaction inhibitors are monoamines (e.g. diethyl amine, dibutyl amine, butyl amine, and lauryl amine) and the compounds in which these are blocked (e.g. ketimine compounds).

The modified polyester (i) can be used alone or can be mixed together with a non-modified polyester (ii) contained as a binder resinous principle. By using (ii) together with (i), there is an improvement in the fixing at the low temperature and the gloss when a full-color unit is used. Therefore, the use of (i) together with (ii) is more desirable than using (i) only. Examples of (ii) are polycondensates of polyhydric alcohols (PC) and polyhydric carboxylic acids (PC) similar to the polyester component of (i). Moreover, (ii) is not limited to non-modified polyester and may be a compound modified by a chemical bond other than the urea bond like a component modified by an urethane bond. From the point of view of the fixing at the low temperature and the hot offset resistance, it is desirable that (i) and (ii) are at least partly compatible. Therefore, it is desirable that (ii) and the polyester component of (i) have similar composition. The weight ratio of (i) and (ii) when (ii) is included in (i), is generally from 5/95 to 80/20. The weight ratio from 5/95 to 30/70 is desirable and a range of 5/95 to 25/75 is more desirable. The weight ratio from 7/93 to 20/80 is further more desirable. If the weight ratio of (i) is less than 5 percent, the hot offset resistance is deteriorated and it is unfavorable from the point of view of compatibility of heat conserving resistance and fixing at the low temperature.

The peak molecular weight of (ii) is generally from 1,000 to 10,000. The desirable range is from 2,000 to 8,000 and a range of 2,000 to 5,000 is more desirable. If the peak molecular weight is less than 1,000, the heat conserving resistance is deteriorated and if it is less than 10,000, the fixing at the low temperature is deteriorated. It is desirable that the hydroxyl value of (ii) is not less than 5. The value from 10 to 120 is more desirable and a range of 20 to 80 is particularly desirable for the hydroxyl value of (ii). If the hydroxyl value is less than 5, it is unfavorable from the point of view of compatibility of the heat conserving resistance and the fixing at the low temperature. It is desirable that the acid value of (ii) is from 1 to 5 and a range of 2 to 4 is more desirable. Because a wax having a high acid value is used, the binder is a low acid value binder resulting in charging and high volume resistance. Therefore, it is easy to match the binder that matches with the toner that is used in a two-component developer.

The glass transition point (Tg) of a binder resin is generally from 45° C. to 65° C. and the desirable range is from 45° C. to 60° C. If the glass transition point (Tg) is less than 45° C., the heat conserving resistance of the toner is deteriorated and if it is more than 65° C., the fixing at the low temperature is insufficient.

Because the urea-modified polyester tend to exist on the surface of the host particles of the toner obtained, even if the glass transition point (Tg) is lower as compared to tat of the known polyester-based toners, it has a tendency to have good heat conserving resistance.

Known materials may be suitably selected for the colorant, charge controlling agent, the mold release agent and the like.

A description will be given of a method of manufacturing the toner. The method described hereunder is a desirable method, and the manufacturing method of the toner is not limited to such.

The method of manufacturing the toner includes the following steps.

A toner material solution is prepared by allowing a colorant, a non-modified polyester, a polyester prepolymer having an isocyanate group, and a mold releasing agent to disperse in an organic solvent. It is desirable to have a volatile organic solvent having a boiling point below 100° C. because the removal after forming of the host particles of the toner is facilitated. More particularly, toluene, xylene, benzene, carbon tetrachloride, methylene chloride, 1,2-dichloromethane, 1,2,2-trichloromethane, trichloroethylene, chloroform, monochlorobenzene, dichloroethylidine, methyl acetate, ethyl acetate, methyl ethyl ketone, methyl isobutyl ketone etc. can be used solely or a combination of two or more of these may be used. Aromatic solvents of toluene, xylene etc. and halogen hydrocarbons of methylene chloride, 1,2-dichloroethane, chloroform, carbon tetrachloride etc. are particularly desirable. The amount of the organic solvent to be used is generally from 0 to 300 parts by weight per 100 parts by weight of polyester prepolymer. The desirable amount is from 0 to 100 parts by weight and a range of 25 to 70 parts by weight is more desirable.

The toner material solution is emulsified in an aqueous medium in the presence of a surfactant and fine particles of resin. An aqueous medium may be solely water or an aqueous medium containing an organic solvent like an alcohol (methanol, isopropyl alcohol, ethylene glycol, etc.), dimethyl formamide, tetrahydrofuran, cellosorb (methyl cellosorb, etc.), and lower ketone (acetone, methyl ethyl ketone, etc.).

The amount to be used of an aqueous medium per 100 parts by weight of the toner material solution is generally from 50 to 2,000 parts by weight and it is desirable to have this amount from 100 to 1,000 parts by weight. If the amount is less than 50 parts by weight, it affects the dispersion of the toner material solution and toner particles of a predetermined particle size cannot be obtained. An amount of more than 20,000 weight parts is not economical.

Further, to improve the dispersion in the aqueous medium, an appropriate dispersing agent like a surfactant, and fine particles of resin are added.

Examples of the surfactants are anionic surfactants like alkyl benzene sulfonate, α-olefin sulfonate, ester phosphate, amine salts like alkyl amine salt, amino alcohol fatty acid derivatives, polyamine fatty acid derivatives, imidazoline, cationic surfactants of quaternary ammonium salt types like alkyl trimethyl ammonium salts, dialkyl dimethyl ammonium salts, alkyl dimethyl benzyl ammonium salts, pyridinium salts, alkyl isoquinolinium salts, benzethonium chloride, nonionic surfactants of fatty acid amide derivatives and polyhydric alcohol derivatives like alanine, dodecyl di (amino ethyl) glycine, di (octyl amino ethyl) glycine and ampholytic surfactants like N-alkyl-N,N-dimethyl ammonium betaine, etc.

Furthermore, by using a surfactant having a fluoroalkyl group, a desired effect can be achieved with a very small quantity. Examples of the desirable anionic surfactants having a fluoroalkyl group and fluoroalkyl carboxylic acids and their metal salts having a carbon number from 2 to 10, disodium perfluorooctane sulfonyl glutamate, sodium-3[ω-fluoroalkyl (C6 to C11) oxy]-1-alkyl (C3 to C4) sulfonate, sodium 3-[ω-fluoroalkanoyl (C6 to C8)-N-ethyl amino]-1-propane sulfonate, fluoroalkyl (C11 to C20) carboxylic acid and its metal salts, perfluoroalkyl carboxylic acid (C7 to C13) and its metal salts, perfluoroalkyl (C4 to C12) sulfonic acid and its metal salts, perfluorooctane sulfonic acid diethanol amide, N-Propyl-N-(2-hydroxyethyl) perfluorooctane sulfonamide, perfluoroalkyl (C6 to C10) sulfonamide propyl trimethyl ammonium salts, perfluoroalkyl (C6 to C10)-N-ethyl sulfonyl glysine salts, ester mono-perfluoroalkyl (C6 to C10) ethyl phosphate.

Examples of commercial products available are SURFLON S-111, S-112, S-113 (manufactured by ASAHI GLASS CO., LTD.), FLUORAD FC-93, FC-95, FC-98, FC-129 (manufactured by SUMITOMO 3M Co., LTD.), UNIDINE DS-101, DS-102 (manufactured by DAIKIN INDUSTRIES, LTD.), MEGAFACE F-110, F-120, F-113, F-191, F-812, F-833 (manufactured by DAI NIPPON INK & CHEMICALS, INC.), EKTOP EF-102, 103, 104, 10 parachloro orthonitro aniline red, lithol fast scarlet G, brilliant fast scarlet, brilliant carmine BS, permanent 5, 112, 123A, 123B, 306A, 501, 201, and 204 (manufactured by TOCHEM PRODUCTS, CO., LTD.), and FTERGENT F-100 and F-150 (manufactured by NEOS CO., LTD.).

Examples of cationic surfactants are primary aliphatic acids, secondary aliphatic acids or secondary amino acids having a fluoroalkyl group, quaternary aliphatic ammonium salts like perfluoroalkyl (C6 to C10) suldonamide propyl trimethyl ammonium salts, etc., benzalkonium salts, benzethonium chloride, pyridinium salts, and imidazolinium salts. Examples of commercial products are SURFLON S-121 (manufactured by ASAHI GLASS CO., LTD.), FLUORAD FC-135 (manufactured by SUMITOMO 3M CO., LTD.), UNIDINE DS-202 (manufactured by DAIKIN INDUSTRIES, LTD.), MEGAFACE F-150, F-824 (manufactured by DAI NIPPON INK & CHEMICALS, INC.), EKTOP EF-132 (manufactured by TOCHEM PRODUCTS CO., LTD.), and FTERGENT F-300 (manufactured by NEOS CO., LTD.).

The fine particles of resin may be made of any kind of resin capable of forming an aqueous disperser, and a thermoplastic resin or a thermosetting resin may be used therefor. Examples of such resins include vinyl-based resin, polyurethane resin, epoxy resin, polyester resin, polyamide resin, polyamide resin, silicon-based resin, phenol resin, melamine resin, urea resin, aniline resin, iononer resin, polycarbonate resin and the like. A combination of two or more such resins may be used. From the point of view of the ease with which the aqueous disperser having fine spherical shaped resin particles are obtainable, the vinyl-based resin, the polyurethane resin, the epoxy resin, the polyester resin and a combination of two or more such resins is preferably used as the resin. Examples of the vinyl-based resins include polymers obtained by polymerization or copolymerization of vinyl-based monomers, such as styrene-(meta) ester acrylate copolymer, styrene-butadiene copolymer, (meta) acrylate-ester acrylate copolymer, styrene-acrylonitrile copolymer, styrene-maleic anhydride copolymer, styrene-(meta) acrylate copolymer and the like. The average particle size of the fine resin particles is from 5 nm to 200 nm, and preferably from 20 nm to 30 nm.

The fine particles of resin are added to stabilize the host particles of the toner that are formed in the aqueous medium. Therefore, it is desirable that the fine particles of rein are added to make 10 to 90 percent covering on the surface of the host particles of the toner. Examples are fine particles of methyl polymethacrylate having a particle size of 0.5 μm and 2 μm, fine particles of poly (styrene-acryl nitrile) having a particle size of 1 μm. Examples of commercial products are PB-200H (manufactured by KAO CORPORATION), SGP (manufactured by SOKEN CO., LTD.), TECHPOLYMER-SB (manufactured by SEKISUI CHEMICAL CO., LTD.), SGP-3G (manufactured by SOKEN CO., LTD.), and MICROPEARL (manufactured by SEKISUI CHEMICAL CO., LTD.). Moreover, inorganic dispersing agents like calcium phosphate-tribasic, calcium carbonate, titanium oxide, colloidal silica, and hydroxyapatite can also be used.

The dispersion droplets may be stabilized by a high polymer protective colloid as a dispersing agent that can be used both as fine particles of rein and of an inorganic dispersing agent. For example, acids like acrylic acid, methacrylic acid, α-cyanoacrylic acid, α-cyanomethacrylic acid, itanoic acid, crotonic acid, fumaric acid, maleic acid or anhydrous meleic acid, or (metha) acrylic monomers that include a hydroxyl group like β-hydroxyethyk acrylate, β-hydroxyethyl methacrylate, β-hydroxypropyl acrylate, β-hydroxypropyl methacrylate, γ-hydroxypropyl acrylate, γ-hydroxyproly methacrylate, 3-chloro 2-hydroxypropyl acrylate, 3-chloro 2-hydroxypropyl methacrylate, diethylene glycol monoacrylic ester, diethylene glycol monomethacrylic ester, glycerin monoacrylic ester, glycerin monomethacrylic ester, N-methylol acryl amide, N-methylol methacryl amide, vinyl alcohols or ethers of vinyl alcohols like vinyl methyl ester, vinyl ethyl ether, vinyl propyl ether, or esters of compounds that include vinyl alcohol or a carboxyl group like vinyl acetate, vinyl propionate, vinyl butyrate, acryl amides, methacryl amides, diacetone acryl amide or their methylol compounds, acid chlorides like an acrylic acid chloride, a methacrylic acid chloride, nitrogenous substances like vinyl pyridine, vinyl pyrrolidine, vinyl imidazole, ethylene imines and homopolymers or copolymers of compounds having the heterocycles of these substances, polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, polyoxyethylene nonyl phenyl ester, celluloses like methyl cellulose, hydroxyethyl cellulose, hydroxypropyl cellulose, etc. are used.

The dispersion method is not limited to a particular method, and a known apparatus like a low-speed shearing disperser, a high-speed shearing disperser, friction disperser, high-pressure jet disperser, and ultrasonic disperser can be used. Among these, the high-speed shearing disperser is desirable to make the particle size of a dispersing element from 2 μm to 20 μm. If the high-speed shearing is used, the number of revolutions per minute (rpm) is not limited to a certain value, but is generally from 1,000 rpm to 30,000 rpm. The desirable range of the number of revolutions per minute is 5,000 rpm to 20,000 rpm. The dispersing time is not limited to a particular value. However, in a case of batch dispersion, the dispersing time is generally from 0.1 minute to 5 minutes. The temperature during the dispersion is generally from 0° C. to 150° C. (under pressure) and the desirable range of the temperature is 40° C. to 98° C.

While preparing an emulsified liquid, amine (B) is added and a reaction is permitted to take place with a polyester prepolymer (A) having an isocyanate group. This reaction involves a cross linking reaction and/or extension reaction of a molecular chain. The reaction time is selected according to the reactivity of the amine (B) with a structure of an isocyanate group of the polyester prepolymer (A) and is generally from 10 minutes to 40 hours. The desirable reaction time is from 2 hours to 24 hours. The reaction temperature is generally from 0° C. to 150° C. and the desirable temperature is from 40° C. to 98° C. Moreover, a known catalyst can be used according to the requirement. Particular examples of the catalyst are dibutyl tin laurate and dioctyl tin laurate.

On completion of the reaction, the organic solvent is removed from the emulsified dispersing element (reaction compound), washed, and dried to obtain the host particles of the toner. To remove the organic solvent, the whole system is heated up while laminar flow stirring. Around a particular temperature, the mixture is stirred vigorously and then the fusiform host particles of the toner are prepared by carrying out diliquoring. Further, if a compound like a calcium phosphate salt that dissolves in an acid or an alkali is used as a dispersion stabilizer, after the calcium phosphate salt is dissolved in an acid like hydrochloric acid, the calcium phosphate salt is removed from the host particles of the toner according to a method of cleaning. It can also be removed by decomposition by an enzyme.

A charge controlling agent is penetrated into the host particles of the toner thus obtained, and inorganic fine particles like those of silica, titanium oxide, etc. are added externally to obtain the toner. The penetrating of the charge controlling agent and the addition of the inorganic fine particles are carried out by a known method using a mixer, etc. Thus, a toner having a sharp particle size distribution and with a small particle size, can be obtained easily. Moreover, by vigorous stirring for removing the organic solvent, the shape of particles from perfectly spherical to rugby or football ball shape can be controlled. Furthermore, the morphology of the particle surface can also be controlled between the smooth and the rough.

Inorganic fine particles may be used as an external additive to assist the fluidity, the developing and the charging of the toner particles. Hydrophobic silica and/or hydrophobic titanium oxide fine particles are particularly desirable for use as the inorganic fine particles. A primary particle size of the inorganic fine particles is from $5\times10^{-3}$ μm to 2 μm, and more desirably from $5\times10^{-3}$ μm to 0.5 μm. Further, it is desirable that a specific surface area according to the BET method is from 20 $m^2/g$ to 500 $m^2/g$. It is desirable that the proportion of the inorganic fine particles to be used is from 0.01 weight percent to 5 weight percent of the toner and a range of 0.01 weight percent to 2.0 weight percent is particularly desirable.

Other examples of the inorganic fine particles include silica, alumina, titanium oxide, barium titanate, magnesium titanate, calcium titanate, strontium titanate, zinc oxide, tin oxide, silica sand, clay, mica, wollastonite, diatomaceous earth, chromium oxide, ceric oxide, red oxide, antimony trioxide, magnesium oxide, zirconium oxide, barium sulfate, barium carbonate, calcium carbonate, silicon carbide and silicon nitride. Other examples of the inorganic fine particles include polymer fine particles such as soap-free emulsion polymers and suspension polymers, polystyrene, ester metacrylate and ester acrylate copolymers obtained by dispersion polymerization, polycondensates such as silicone, benzoguanamine and nylon, and thermosetting resin.

The surface treating by the surfactant improves the hydrophobic characteristic, and prevents deterioration of the fluidity and charging characteristic even under a high humidity. Examples of suitable surfactants include silane coupling agent, sillilation reagent, silane coupling agent having fluoride alkyl group, organic titanate-based coupling agent, aluminum-based coupling agent, silicone oil, and denaturated silicone oil.

The toner described above may be mixed with a magnetic carrier and used as a two-component developer. In this case, the toner density with respect to the magnetic carrier within the developer is preferably from 1 to 10 parts by weight per 100 parts by weight of the magnetic carrier. In addition, the toner described above may be used as a one-component magnetic toner or non-magnetic toner that codes not use a carrier.

Further, the present invention is not limited to these embodiments, but various variations and modifications may be made without departing from the scope of the present invention.

The application claims priority to Japanese patent application nos. 2004-021765, 2004-318372, 2004-057323, and 2004-023240, filed on Jan. 29, 2004, Nov. 1, 2004, Mar. 2, 2004, and Jan. 30, 2004, the disclosures of which are incorporated by reference herein in their entirety.

The invention claimed is:

1. A process cartridge for an image forming apparatus, comprising:

a process cartridge frame body configured to be removably mounted in the image forming apparatus, the process cartridge frame body including a first body member and a second body member pivotally interconnected to the first body member so that at least one of the first and second body members is movable between an opened position and a closed position;

an image bearing member mounted on at least one of the first and second body members; and an auxiliary device configured to cooperate with the image bearing member and to be mounted on at least one of the first and second body members as part of the process cartridge, the auxiliary device is configured to be mounted via an opened space formed when at least one of the first and second body members is in the opened position.

2. The process cartridge as claimed in claim 1, wherein the second body member is pivotably mounted on the first body member so that at least one of the first and second body members is pivotably movable between the opened position and the closed position.

3. The process cartridge as claimed in claim 1, wherein the auxiliary device includes a plurality of devices configured to be replaced at intervals different from one another.

4. The process cartridge as claimed in claim 1, wherein the auxiliary device includes a plurality of devices configured to be replaced at a same interval.

5. The process cartridge as claimed in claim 1, wherein the auxiliary device includes a cleaning member.

6. The process cartridge as claimed in claim 1, further comprising a developing device configured to provide a developer to the image bearing member, the developing device includes a developing agent accommodating device configured to accommodate a toner.

7. The process cartridge as claimed in claim 6, further comprising toner disposed in the developing agent accommodating device.

8. The process cartridge as claimed in claim 1, further comprising a charging device configured to be detachably mounted on at least one of the first and second body members, the auxiliary device and the image bearing member are configured to be removed via an opened space formed when at least one of the first and second body members is in the opened position.

9. The process cartridge as claimed in claim 1, wherein at least one of the first and second body members includes a detecting device.

10. A process cartridge configured to be detachably mounted in an image forming apparatus, comprising:

a first body member;

a second body member mounted on the first body member so that at least one of the first and second body members is movable between an opened position and a closed position;

an image bearing member mounted on at least one of the first and second body members; and an auxiliary device configured to cooperate with the image bearing member and to be mounted on at least one of the first and second body members as part of the process cartridge, the auxiliary device is configured to be mounted via an opened space formed when at least one of the first and second body members is in the opened position, wherein the second body member is pivotably mounted on the first body member so that at least one of the first and second body members is pivotably movable between the opened position and the closed position, further comprising a transport auger configured to transport a residual toner outside the process cartridge, the transport auger is coaxial with an axis about which at least one of the first and second body members is configured to pivot.

11. A process cartridge configured to be detachably mounted in an image forming apparatus, comprising:

a first body member;

a second body member mounted on the first body member so that at least one of the first and second body members is movable between an opened position and a closed position;

an image bearing member mounted on at least one of the first and second body members; and an auxiliary device configured to cooperate with the image bearing member and to be mounted on at least one of the first and second body members as part of the process cartridge, the auxiliary device is configured to be mounted via an opened space formed when at least one of the first and second body members is in the opened position, wherein the auxiliary device includes a cleaning member, further comprising:

a first positioning member configured to retain the first and second body members; and a second positioning member configured to retain the cleaning member on at least one of the first and second body members.

12. The process cartridge as claimed in claim 11, wherein the second positioning member is mounted at first and second ends of the process cartridge.

13. The process cartridge as claimed in claim 11, wherein the second positioning member is configured to be overlapped by at least one of the first and second body members when the first and second body members are in the closed position.

14. A process cartridge configured to be detachably mounted in an image forming apparatus, comprising:

a first body member;

a second body member mounted on the first body member so that at least one of the first and second body members is movable between an opened position and a closed position;

an image bearing member mounted on at least one of the first and second body members; and an auxiliary device configured to cooperate with the image bearing member and to be mounted on at least one of the first and second body members as part of the process cartridge, the auxiliary device is configured to be mounted via an opened space formed when at least one of the first and second body members is in the opened position, wherein the auxiliary device includes a cleaning member, wherein the cleaning member includes a cleaning blade configured to remove a toner on the image bearing member and a coating roller configured to supply a lubricant on the image bearing member, and wherein the cleaning blade and the coating roller are disposed in different modules.

15. A process cartridge configured to be detachably mounted in an image forming apparatus, comprising:

a first body member;

a second body member mounted on the first body member so that at least one of the first and second body members is movable between an opened position and a closed position;

an image bearing member mounted on at least one of the first and second body members; and an auxiliary device configured to cooperate with the image bearing member and to be mounted on at least one of the first and second body members as part of the process cartridge, the auxiliary device is configured to be mounted via an opened space formed when at least one of the first and second body members is in the opened position, wherein the auxiliary device includes a cleaning member, wherein the cleaning member includes a cleaning blade and a bias roller configured to remove a toner on the image bearing member, and wherein the cleaning blade and the bias roller are disposed in modules.

16. A process cartridge configured to be detachably mounted in an image forming apparatus, comprising:

a first body member;

a second body member mounted on the first body member so that at least one of the first and second body members is movable between an opened position and a closed position;

an image bearing member mounted on at least one of the first and second body members; and an auxiliary device configured to cooperate with the image bearing member and to be mounted on at least one of the first and second body members as part of the process cartridge, the auxiliary device is configured to be mounted via an opened space formed when at least one of the first and second body members is in the opened position, wherein the auxiliary device is configured to be removed when the second body member is turned approximately 90 degrees with respect to the first body member and opened.

17. The process cartridge as claimed in claim 16, wherein the auxiliary device is configured to be removed in a substantially vertical direction.

18. A process cartridge configured to be detachably mounted in an image forming apparatus, comprising:

a first body member;

a second body member mounted on the first body member so that at least one of the first and second body members is movable between an opened position and a closed position;

an image bearing member mounted on at least one of the first and second body members; and an auxiliary device configured to cooperate with the image bearing member and to be mounted on at least one of the first and second body members as part of the process cartridge, the auxiliary device is configured to be mounted via an opened space formed when at least one of the first and second body members is in the opened position, wherein the image bearing member is configured to be removed via the opened space when one of the first and second body members is in the closed position.

19. The process cartridge as claimed in claim 18, wherein the auxiliary device includes a cleaning member, and wherein the cleaning member and the image bearing member are configured to be removed independently.

20. The process cartridge as claimed in claim 18, wherein the auxiliary device and the image bearing member are configured to be removed after the process cartridge is removed from the image forming apparatus.

21. The process cartridge as claimed in claim 18, wherein the image bearing member is configured to be positioned on a driving shaft of the image forming apparatus.

22. A process cartridge configured to be detachably mounted in an image forming apparatus, comprising:

a first body member;

a second body member mounted on the first body member so that at least one of the first and second body members is movable between an opened position and a closed position;

an image bearing member mounted on at least one of the first and second body members; and an auxiliary device configured to cooperate with the image bearing member and to be mounted on at least one of the first and second body members as part of the process cartridge, the auxiliary device is configured to be mounted via an opened space formed when at least one of the first and second body members is in the opened position, further comprising a developing device configured to provide a developer to the image bearing member, the developing device includes a developing agent accommodating device configured to accommodate a toner, further comprising toner disposed in the developing agent accommodating device, wherein the toner has an average circularity from 0.93 to 1.00.

23. A process cartridge configured to be detachably mounted in an image forming apparatus, comprising:

a first body member;

a second body member mounted on the first body member so that at least one of the first and second body members is movable between an opened position and a closed position;

an image bearing member mounted on at least one of the first and second body members; and an auxiliary device configured to cooperate with the image bearing member and to be mounted on at least one of the first and second body members as part of the process cartridge, the auxiliary device is configured to be mounted via an opened space formed when at least one of the first and second body members is in the opened position, further comprising a developing device configured to provide a developer to the image bearing member, the developing device includes a developing agent accommodating device configured to accommodate a toner, further comprising toner disposed in the developing agent accommodating device, wherein the toner has a ratio of volume average particle size and a number average particle size from 1.05 to 1.40.

24. A process cartridge configured to be detachably mounted in an image forming apparatus, comprising:

a first body member;

a second body member mounted on the first body member so that at least one of the first and second body members is movable between an opened position and a closed position;

an image bearing member mounted on at least one of the first and second body members; and an auxiliary device configured to cooperate with the image bearing member and to be mounted on at least one of the first and second body members as part of the process cartridge, the auxiliary device is configured to be mounted via an opened space formed when at least one of the first and second body members is in the opened position, further comprising a developing device configured to provide a developer to the image bearing member, the developing device includes a developing agent accommodating device configured to accommodate a toner, further comprising toner disposed in the developing agent accommodating device, wherein the toner includes particles having a ratio $r2/r1$ of a minor axis $r2$ and a major axis $r1$ from 0.5 to 1.0, a ratio $r3/r2$ of a thickness $r3$ and the minor axis $r2$ from 0.7 to 1.0, and $r1 \geqq r2 \geqq r3$.

25. A process cartridge configured to be detachably mounted in an image forming apparatus, comprising:

a first body member;

a second body member mounted on the first body member so that at least one of the first and second body members is movable between an opened position and a closed position;

an image bearing member mounted on at least one of the first and second body members; and an auxiliary device configured to cooperate with the image bearing member and to be mounted on at least one of the first and second body members as part of the process cartridge, the auxiliary device is configured to be mounted via an opened space formed when at least one of the first and second body members is in the opened position, further comprising a developing device configured to provide a developer to the image bearing member, the developing device includes a developing agent accommodating device configured to accommodate a toner, further comprising toner disposed in the developing agent accommodating device, wherein the toner is formed from a toner material solution in which at least one of a cross linking reaction and an extension reaction occurs in an aqueous medium, where the toner material solution is obtained by at least one of dissolving and dispersing at least a polyester prepolymer having a functional group that includes nitrogen atoms, a polyester, a colorant and a mold releasing agent within an organic solvent.

26. A process cartridge configured to be detachably mounted in an image forming apparatus, comprising:

a first body member;

a second body member mounted on the first body member so that at least one of the first and second body members is movable between an opened position and a closed position;

an image bearing member mounted on at least one of the first and second body members; and an auxiliary device configured to cooperate with the image bearing member and to be mounted on at least one of the first and second body members as part of the process cartridge, the auxiliary device is configured to be mounted via an opened space formed when at least one of the first and second body members is in the opened position, wherein at least one of the first and second body members includes a detecting device, and wherein the detecting device includes at least one of a temperature sensor, a humidity sensor, a potential sensor configured to detect a potential of an image bearing member, and a toner density sensor configured to detect an amount of toner developed on an image bearing member after developing.

27. The process cartridge as claimed in claim 26, wherein at least one of the first and second body members includes a connector configured to retain signal lines of the detecting device.

28. A process cartridge configured to be detachably mounted in an image forming apparatus, comprising:

a first body member;

a second body member mounted on the first body member so that at least one of the first and second body members is movable between an opened position and a closed position;

an image bearing member mounted on at least one of the first and second body members; and an auxiliary device configured to cooperate with the image bearing member and to be mounted on at least one of the first and second body members as part of the process cartridge, the auxiliary device is configured to be mounted via an opened space formed when at least one of the first and second body members is in the opened position, wherein the image bearing member includes gears disposed around a bearing, and wherein the auxiliary device and the image bearing member are configured to be removed via an opened space formed when at least one of the first and second body members is in the opened position.

29. The process cartridge as claimed in claim 28, wherein the image bearing member is configured to be positioned on a driving shaft of the image forming apparatus.

30. The process cartridge as claimed in claim 28, wherein the image bearing member is configured to be positioned on a driving shaft of the image forming apparatus that positions the process cartridge.

31. The process cartridge as claimed in claim 28, further comprising a spring configured to urge the image bearing member in a direction opposite to a direction in which the process cartridge is mounted on the image forming apparatus.

32. The process cartridge as claimed in claim 28, wherein the image bearing member is configured to be removed after the process cartridge is removed from the image forming apparatus.

33. The process cartridge as claimed in claim 28, further comprising a positioning member configured to dispose the auxiliary device on at least one of the first and second body members, the auxiliary device and the image bearing member are configured to be removed via the opened space formed when at least one of the first and second body members is in the opened position.

34. The process cartridge as claimed in claim 33, further comprising a charging device configured to be detachably mounted on at least one of the first and second body members.

35. A process cartridge configured to be detachably mounted in an image forming apparatus, comprising:

a process cartridge frame body;

a developing module comprising a developer bearing member configured to supply a developing agent to an image bearing member, a magnet unit having a predetermined main pole direction, the magnet unit being disposed inside the developer bearing member, and a rotatable shaft configured to rotate the magnet unit;

a positioning member configured to position the developing module on the process cartridge frame body; and an angular positioning member having a first portion removably attached to the process cartridge frame body and a second portion configured to engage the rotatable shaft to position the predetermined main pole direction of the magnet unit.

36. The process cartridge as claimed in claim 35, wherein the positioning member is configured to position the developer bearing member with respect to the image bearing member.

37. The process cartridge as claimed in claim 35, wherein the angular positioning member is configured to position the predetermined main pole direction of the magnet unit after the developing module is fixed on the process cartridge by the positioning member.

38. The process cartridge as claimed in claim 35, wherein a portion of the rotatable shaft engaged by the angular positioning member has a D-shape cross section.

39. The process cartridge as claimed in claim 35, further comprising:

the image bearing member; and a cleaning module configured to remove residual toner on the image bearing member.

40. The process cartridge as claimed in claim 35, wherein the developing module includes a developing agent accommodating device configured to accommodate a toner.

41. A process cartridge configured to be detachably mounted in an image forming apparatus, comprising:

a developing module comprising a developer bearing member configured to supply a developing agent to an image bearing member, a magnet unit having a predetermined main pole direction, the magnet unit being disposed inside the developer bearing member, and a rotatable shaft configured to rotate the magnet unit;

a positioning member configured to position the developing module on the process cartridge; and an angular positioning member configured to engage the rotatable shaft to position the predetermined main pole direction of the magnet unit, wherein the angular positioning member is disposed above the positioning member.

42. A process cartridge configured to be detachably mounted in an image forming apparatus, comprising:

a developing module comprising a developer bearing member configured to supply a developing agent to an image bearing member, a magnet unit having a predetermined main pole direction, the magnet unit being disposed inside the developer bearing member, and a rotatable shaft configured to rotate the magnet unit;

a positioning member configured to position the developing module on the process cartridge; and an angular positioning member configured to engage the rotatable shaft to position the predetermined main pole direction of the magnet unit, wherein the developing module includes a developing agent accommodating device configured to accommodate a toner, further comprising toner having an average circularity from 0.93 to 1.00.

43. A process cartridge configured to be detachably mounted in an image forming apparatus, comprising:

a developing module comprising a developer bearing member configured to supply a developing agent to an image bearing member, a magnet unit having a predetermined main pole direction, the magnet unit being disposed inside the developer bearing member, and a rotatable shaft configured to rotate the magnet unit;

a positioning member configured to position the developing module on the process cartridge; and an angular positioning member configured to engage the rotatable shaft to position the predetermined main pole direction of the magnet unit, wherein the developing module includes a developing agent accommodating device configured to accommodate a toner, further comprising toner having a ratio of volume average particle size and a number average particle size from 1.05 to 1.40.

44. A process cartridge configured to be detachably mounted in an image forming apparatus, comprising:

a developing module comprising a developer bearing member configured to supply a developing agent to an image bearing member, a magnet unit having a predetermined main pole direction, the magnet unit being disposed inside the developer bearing member, and a rotatable shaft configured to rotate the magnet unit;

a positioning member configured to position the developing module on the process cartridge; and an angular positioning member configured to engage the rotatable shaft to position the predetermined main pole direction of the magnet unit, wherein the developing module includes a developing agent accommodating device configured to accommodate a toner, further comprising toner having particles with a ratio $r2/r1$ of a minor axis $r2$ and a major axis $r1$ from 0.5 to 1.0, and a ratio $r3/r2$ of a thickness $r3$ and the minor axis $r2$ from 0.7 to 1.0, wherein $r1 \geqq r2 \geqq r3$.

45. A process cartridge configured to be detachably mounted in an image forming apparatus, comprising:

a developing module comprising a developer bearing member configured to supply a developing agent to an image bearing member, a magnet unit having a predetermined main pole direction, the magnet unit being disposed inside the developer bearing member, and a rotatable shaft configured to rotate the magnet unit;

a positioning member configured to position the developing module on the process cartridge; and an angular positioning member configured to engage the rotatable shaft to position the predetermined main pole direction of the magnet unit, wherein the developing module includes a developing agent accommodating device configured to accommodate a toner, further comprising toner formed from a toner material solution in which at least one of a cross linking reaction and an extension reaction occurs in an aqueous medium, where the toner material solution is obtained by at least one of dissolving and dispersing at least a polyester prepolymer having a functional group that includes nitrogen atoms, a polyester, a colorant and a mold releasing agent within an organic solvent.

46. A process cartridge for an image forming apparatus, comprising:

means for cooperating with means for bearing an image; and a process cartridge frame body configured to be removably mounted in the image forming apparatus, the process cartridge frame body including means for opening and closing a space, wherein the means for opening and closing include a first body member and a second body member pivotally interconnected to the first body member, and wherein the means for cooperating is configured to be mounted to the process cartridge frame body via an opened space formed when the means for opening and closing is open.

47. The process cartridge as claimed in claim 46, further comprising the means for bearing an image, the means for bearing configured to be mounted to the means for opening and closing via the opened space.

48. The process cartridge as claimed in claim 46, further comprising means for supplying a developing agent to the means for bearing.

49. An image forming apparatus, comprising a process cartridge comprising:

an image bearing member;

an auxiliary device; and a process cartridge frame body configured to be removably mounted in said image forming apparatus, the process cartridge frame body including a first body member and a second body member pivotally interconnected to the first body member so that at least one of the first and second body members is movable between an opened position and a closed position, wherein the auxiliary device is configured to be mounted to the process cartridge frame body via an opened space formed when at least one of the first and second body members is in the opened position, after the process cartridge is removed from said image forming apparatus.

50. The apparatus as claimed in claim 49, wherein the image bearing member is configured to be removed via the opened space.

51. The apparatus as claimed in claim 50, further comprising a developing device configured to develop an image.

52. The apparatus as claimed in claim 51, wherein the developing device includes a developing agent accommodating device configured to accommodate a toner.

53. The apparatus as claimed in claim 49, wherein the auxiliary device includes a cleaning member.

54. An image forming apparatus, comprising:

a process cartridge comprising a process cartridge frame body, an image bearing member, a developing module configured to be detachably mounted on the process cartridge, the developing module including a developer bearing member configured to supply a developing agent to the image bearing member, a magnet unit having a predetermined main pole direction, the magnet unit being disposed inside the developer bearing member, and a rotatable shaft configured to rotate the magnet unit;

a positioning member configured to position the developing module on the process cartridge frame body; and an angular positioning member having a first portion removably attached to the process cartridge frame body and a second portion configured to engage the rotatable shaft to position the predetermined main pole direction of the magnet unit.

55. The apparatus as claimed in claim 54, further comprising a cleaning device configured to remove residual toner.

56. The apparatus as claimed in claim 55, wherein the cleaning device is configured to be removed after the process cartridge is removed from the image forming apparatus.

57. A process cartridge for an image forming apparatus, comprising:

means for bearing an image;

means for cooperating with the means for bearing;

means for mounting the means for bearing and the means for cooperating in first and second body members, the means for mounting being configured to be removably mounted in the image forming a apparatus; and means for connecting the first and second body members to be movable between an opened position and a closed position, wherein the means for cooperating is configured to be mounted via an opened space formed when at least one of the first and second body members is in the opened position, and wherein the first and second body members are pivotally interconnected to each other.

58. The process cartridge as claimed in claim 57, wherein the means for bearing is configured to be mounted via the opened space.

59. A process cartridge configured to be detachably mounted in an image forming apparatus, comprising:

means for bearing an image;

means for supplying a developing agent to the means for bearing, the means for supplying comprising a developing sleeve;

means for attracting the developing agent, the means for attracting including a magnet unit;

means for determining a position between the developing sleeve and the means for bearing; and means for adjustably determining an angular position of a predetermined main pole direction of the magnet unit with respect to the means for bearing.

60. The apparatus as claimed in claim 59, further comprising means for mounting the means for bearing, wherein the means for bearing is configured to be mounted via an opened space formed by the means for mounting.

61. An image forming apparatus, comprising:

means for bearing an image;

means for cooperating with the means for bearing;

means for mounting the means for bearing and the means for cooperating in first and second body members, the means for mounting being configured to be removably mounted in said image forming apparatus; and means for connecting the first and second body members to be movable between an opened position and a closed position, wherein the means for cooperating is configured to be mounted via an opened space formed when at least one of the first and second body members is in the opened position, and wherein the first and second body members are pivotally interconnected to each other.

62. An image forming apparatus, comprising:

means for bearing an image;

means for supplying a developing agent to the means for bearing, the means for supplying including a developing sleeve inside a developing module;

means for attracting the developing agent by a magnet unit inside the developing sleeve;

means for determining a preliminary position between the developing module and the means for bearing; and means for adjustably determining an angular position of a predetermined main pole direction of the magnet unit with respect to the means for bearing.

63. A method for positioning for an image forming apparatus, comprising:

determining a preliminary position between a developing module and an image bearing member of a process cartridge;

positioning the developing module and the image bearing member at the preliminary position;

determining an angular position of a predetermined main pole direction of a magnet unit inside the developing module;

positioning and adjustably fixing the predetermined main pole direction of the magnet unit inside the developing unit at the angular position; and positioning the process cartridge in the image forming apparatus.

* * * * *